US010911848B2

(12) United States Patent
Yoon et al.

(10) Patent No.: US 10,911,848 B2
(45) Date of Patent: Feb. 2, 2021

(54) SOUND COMPONENT WITH SEALING MEMBER AND ELECTRONIC DEVICE WITH THE SAME

(71) Applicant: Samsung Electronics Co., Ltd., Gyeonggi-do (KR)

(72) Inventors: Chang-Shik Yoon, Seoul (KR); Youngbae Park, Seoul (KR); Joon-Rae Cho, Seoul (KR); Kyung Yeup Kim, Gyeonggi-do (KR); Ho-Chul Hwang, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 78 days.

(21) Appl. No.: 16/106,526

(22) Filed: Aug. 21, 2018

(65) Prior Publication Data

US 2019/0069056 A1 Feb. 28, 2019

(30) Foreign Application Priority Data

Aug. 22, 2017 (KR) ..... 10-2017-0106159

(51) Int. Cl.
*H04R 1/02* (2006.01)
*H04R 31/00* (2006.01)

(52) U.S. Cl.
CPC ..... *H04R 1/023* (2013.01); *H04R 1/025* (2013.01); *H04R 31/00* (2013.01); *H04R 31/006* (2013.01); *H04R 2499/11* (2013.01); *H04R 2499/15* (2013.01)

(58) Field of Classification Search
CPC ..... H04R 1/023; H04R 1/025; H04R 31/00; H04R 31/006; H04R 2499/11; H04R 2499/15
USPC ..... 381/334, 345–354, 55, 189; 455/566, 455/575.1–575.8; 379/433.04, 440, 451
See application file for complete search history.

(56) References Cited

U.S. PATENT DOCUMENTS 8,548,159 B2 * 10/2013 Kawasaki ..... H04M 1/02 379/433.04
8,705,790 B2 4/2014 Kuze
8,867,770 B2 * 10/2014 Chien ..... H04R 1/2803 381/165
8,929,570 B2 * 1/2015 Tao ..... H04R 1/02 381/189

(Continued)

FOREIGN PATENT DOCUMENTS

JP 2009-105610 A 5/2009
JP 2011-139254 A 7/2011

*Primary Examiner* — Xu Mei
(74) *Attorney, Agent, or Firm* — Cha & Reiter, LLC.

(57) ABSTRACT

A slim sound component with a sealing member is provided. The sound component includes: a sound component housing including: a first plate facing toward a first direction; a second plate facing toward a second direction opposite to the first direction; and a third plate facing toward a third direction perpendicular to the first and second directions; a sound generator disposed in the sound component housing to generate a sound in the first direction; a protection member mounted to be exposed through the first plate in the first direction to protect the sound generator; and a sealing member disposed between the sound component housing and the protection member, and the protection member and the sealing member are integrally formed with each other.

17 Claims, 34 Drawing Sheets

(56) References Cited

U.S. PATENT DOCUMENTS

| | | | | |
|---|---|---|---|---|
| 2004/0081325 | A1* | 4/2004 | Rautio | H04M 1/03 381/189 |
| 2009/0245565 | A1* | 10/2009 | Mittleman | H04M 1/035 381/365 |
| 2016/0086745 | A1 | 3/2016 | Seo et al. | |
| 2017/0094382 | A1 | 3/2017 | Worrell et al. | |

* cited by examiner

SOUND COMPONENT WITH SEALING MEMBER AND ELECTRONIC DEVICE WITH THE SAME

CROSS-REFERENCE TO RELATED APPLICATION(S)

This application is based on and claims priority under 35 U.S.C. § 119 to Korean Patent Application No. 10-2017-0106159, filed on Aug. 22, 2017, in the Korean Intellectual Property Office, the disclosure of which is incorporated by reference herein in its entirety.

BACKGROUND

1. Field

The present disclosure relates to a sound component mounted in an electronic device.

2. Description of Related Art

An electronic device including a smart phone, a tablet personal computer (PC), or a wearable device may have at least one sound component mounted in a main body housing thereof. The mounted sound component may have a sound path (an injection molding structure) connected with the outside of the main body housing.

In addition, the mounted sound component may be provided with a waterproof structure to prevent intrusion of foreign substances into a sound generator. The waterproof structure is a structure for preventing penetration of moisture under lower than a specific pressure, and may be disposed on the sound component.

The above information is presented as background information only to assist with an understanding of the present disclosure. No determination has been made, and no assertion is made, as to whether any of the above might be applicable as prior art with regard to the present disclosure.

SUMMARY

If a side surface of the sound component is treated by water-repellent sealing to prevent water from entering the inside of the electronic device through the sound component to increase space and improve waterproof performance under high pressure, the water-repellent sealing treatment may improve sound performance of the sound component.

Various embodiments of the present disclosure provide a sound component which has a side surface sealed to be waterproofed.

Various embodiments of the present disclosure provide a sound component which omits an O-ring member, which is a waterproof structure, and thus enhances sound performance according to an increase of an inner space.

Various embodiments of the present disclosure provide a sound component which omits an O-ring member and thus enhances allowing for easy assembly and lower costs.

According to various embodiments of the present disclosure, a sound component includes: a sound component housing including: a first plate facing toward a first direction; a second plate facing toward a second direction opposite to the first direction; and a third plate facing toward a third direction perpendicular to the first and second directions; a speaker disposed in the sound component housing to generate a sound in the first direction; a protection member mounted to be exposed through the first plate in the first direction to protect the speaker; and a sealing member disposed between the sound component housing and the protection member, such that the protection member and the sealing member are integrally formed with each other.

According to various embodiments of the present disclosure, a sound component includes: a sound component housing including: a first plate facing toward a first direction; a second plate facing toward a second direction opposite to the first direction; and a third plate facing toward a third direction perpendicular to the first and second directions; a speaker disposed in the sound component housing, and provided with a vibration portion facing toward the first direction to generate a sound in the first direction; a sealing member coupled with the sound component housing to prevent intrusion of foreign substances into the electronic device; and a vibration portion coupler which couples the sealing member and the vibration portion of the speaker therebetween, such that the sealing member and the vibration portion are integrally formed with each other.

According to various embodiments of the present disclosure, an electronic device includes: an electronic device housing provided with at least one opening; and at least one sound component mounted in the proximity of the at least one opening, such that the at least one sound component includes: a sound component housing including: a first plate facing toward a first direction; a second plate facing toward a second direction opposite to the first direction; and a third plate facing toward a third direction perpendicular to the first and second directions; a speaker disposed in the sound component housing to generate a sound in the first direction; a protection member mounted to be exposed through the first plate in the first direction to protect the speaker; and a sealing member disposed between the sound component housing and the protection member, and disposed in contact with the electronic device housing in a pressed state, such that the protection member and the sealing member are integrally formed with each other.

The sound component according to various embodiments of the present disclosure provides a waterproof structure which can structurally seal a side surface, and guarantees a space for enhancing sound performance of the speaker.

The sound component according to various embodiments of the present disclosure can achieve sliminess and can enhance sound performance according to an structural increase in the space of the speaker.

The sound component according to various embodiments of the present disclosure can omit an O-ring member and thus can achieve sliminess.

The sound component according to various embodiments of the present disclosure can omit an O-ring member, and contribute to reduction of costs, and also can reduce the number of assembly processes and can enhance assemblability.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1A:
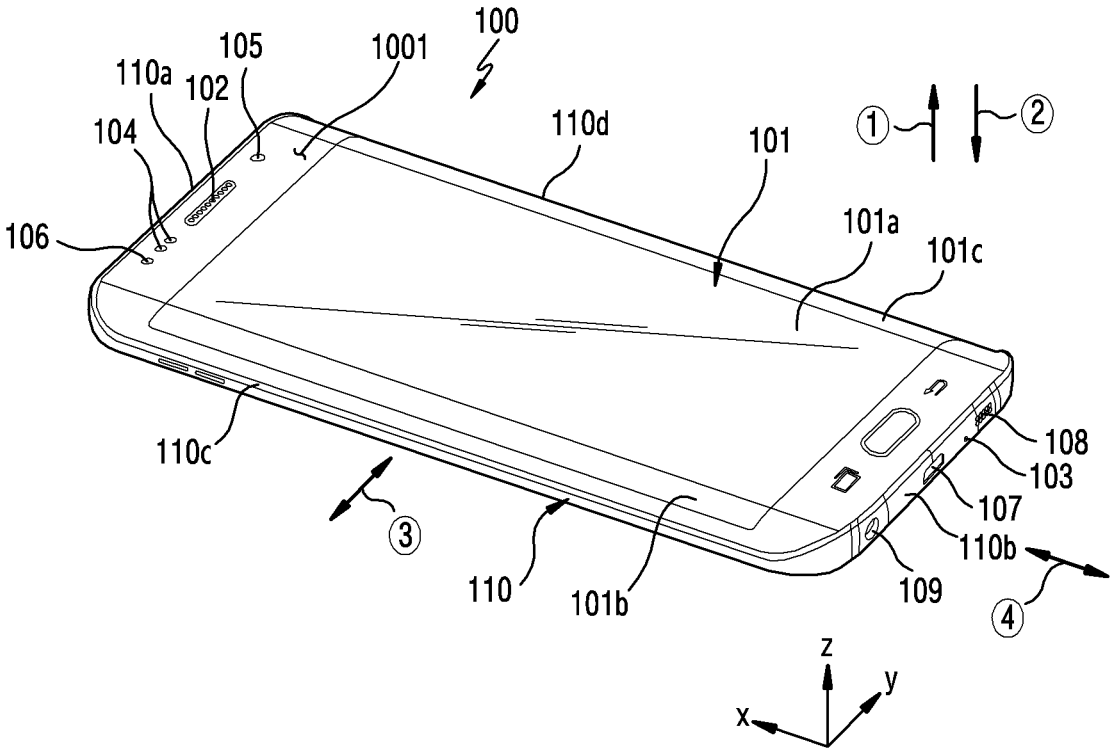
FIG. 1A is a perspective view illustrating a front surface of an electronic device according to various embodiments.

Hereinafter, various embodiments of the present disclosure will be described with reference to accompanying drawings. However, various embodiments of the present disclosure are not limited to specific embodiments, and it should be understood that modification, equivalent, and/or alternative on the various embodiments described herein can be variously made. With regard to description of drawings, similar components may be marked by similar reference numerals.

In the disclosure disclosed herein, the expressions "have," "may have," "include" and "comprise," or "may include" and "may comprise" used herein indicate existence of corresponding features (for example, elements such as numeric values, functions, operations, or components) and do not preclude the presence of additional features.

In the disclosure disclosed herein, the expressions "A or B," "at least one of A or/and B," or "one or more of A or/and B," and the like used herein may include any and all combinations of one or more of the associated listed items. For example, the term "A or B," "at least one of A and B," or "at least one of A or B" may refer to all of the case (1) where at least one A is included, the case (2) where at least one B is included, or the case (3) where both of at least one A and at least one B are included.

The terms, such as "first," "second," and the like used herein, may refer to various elements of various embodiments of the present disclosure, but do not limit the elements. For example, such terms do not limit the order and/or priority of the elements. Furthermore, such terms may be used to distinguish one element from another element. For example, "a first user device" and "a second user device" indicate different user devices regardless of the order or priority. For example, without departing from the present disclosure, a first element may be referred to as a second element, and similarly, a second element may be referred to as a first element.

It will be understood that when an element (for example, a first element) is referred to as being "(operatively or communicatively) coupled with/to" or "connected to" another element (for example, a second element), it can be directly coupled with/to or connected to another element or coupled with/to or connected to another element via an intervening element (for example, a third element). In contrast, when an element (for example, a first element) is referred to as being "directly coupled with/to" or "directly connected to" another element (for example, a second element), it should be understood that there is no intervening element (for example, a third element).

According to the situation, the expression "configured to (or set to)" used herein may be used as, for example, the expression "suitable for," "having the capacity to," "designed to," "adapted to," "made to," or "capable of". The term "configured to (or set to)" must not mean only "specifically designed to" in hardware. Instead, the expression "a device configured to" may mean that the device is "capable of" operating together with another device or other components. For example, a "processor configured to (or set to) perform A, B, and C" may mean a dedicated processor (for example, an embedded processor) for performing a corresponding operation or a generic-purpose processor (for example, a central processing unit (CPU) or an application processor) which may perform corresponding operations by executing one or more software programs which are stored in a memory device.

Terms used in the present disclosure are used to describe specified embodiments of the present disclosure and are not intended to limit the of other embodiments. The terms of a singular form may include plural forms unless otherwise specified. Unless otherwise defined herein, all the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal way, unless expressly so defined herein in various embodiments of the present disclosure. In some cases, even if terms are terms which are defined in the specification, they may not be interpreted to exclude embodiments of the present disclosure.

An electronic device according to various embodiments of the present disclosure may include at least one of smartphones, tablet personal computers (PCs), mobile phones, video telephones, electronic book readers, desktop PCs, laptop PCs, netbook computers, workstations, servers, personal digital assistants (PDAs), portable multimedia players (PMPs), Motion Picture Experts Group (MPEG-1 or MPEG-2) Audio Layer 3 (MP3) players, mobile medical devices, cameras, or wearable devices (for example, smart glasses, head-mounted-devices (HMDs), electronic apparels, electronic bracelets, electronic necklaces, electronic appcessory, electronic tattoos, smart mirrors, or smart watches).

According to certain embodiments, the electronic devices may be smart home appliances. The smart home appliances may include at least one of, for example, televisions (TVs), digital video disk (DVD) players, audios, refrigerators, air conditioners, cleaners, ovens, microwave ovens, washing machines, air cleaners, set-top boxes, home automation control panels, security control panels, TV boxes (for example, Samsung HomeSync™, Apple TV™, or Google TV™), game consoles (for example, Xbox™ and PlayStation™), electronic dictionaries, electronic keys, camcorders, electronic picture frames, and the like.

According to another embodiment, the electronic devices may include at least one of medical devices (for example, various portable medical measurement devices (for example, a blood glucose monitoring device, a heartbeat measuring device, a blood pressure measuring device, a body temperature measuring device, and the like), a magnetic resonance angiography (MRA), a magnetic resonance imaging (MRI), a computed tomography (CT), scanners, and ultrasonic devices), navigation electronic devices, global positioning system receivers (GPSs), event data recorders (EDRs), flight data recorders (FDRs), vehicle infotainment devices, electronic equipment for vessels (for example, navigation systems and gyrocompasses), avionics, security devices, head units for vehicles, industrial or home robots, automatic teller's machines (ATMs) of financial institutions, points of sales (POSs) of stores, or internet of things (for example, light bulbs, various sensors, electric or gas meters, sprinkler devices, fire alarms, thermostats, street lamps, toasters, exercise equipment, hot water tanks, heaters, boilers, and the like).

According to a certain embodiment, the electronic devices may include at least one of a part of furniture or buildings/structures, electronic boards, electronic signature receiving devices, projectors, or various measuring instruments (for example, water meters, electricity meters, gas meters, or wave meters, and the like). The electronic devices according to various embodiments may be one or more combinations of the above-mentioned devices. According to a certain embodiment, an electronic device may be a flexible electronic device. Also, electronic devices according to various embodiments of the present disclosure are not limited to the above-mentioned devices, and may include new electronic devices according to technology development.

Figure 1B:
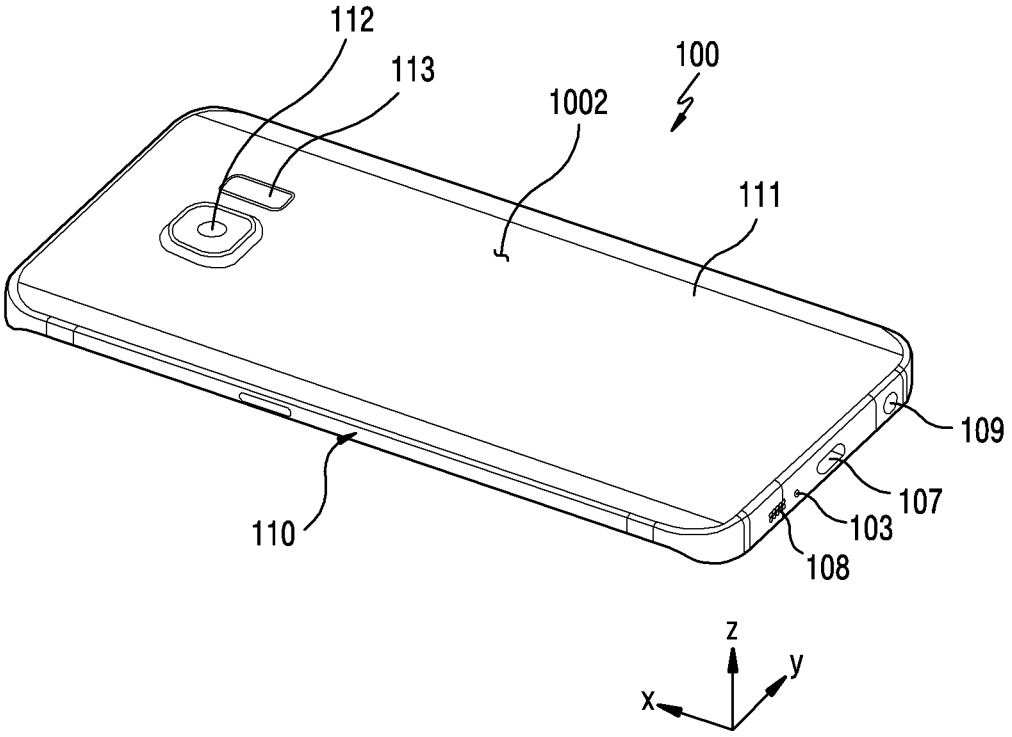
FIG. 1B is a perspective view illustrating a rear surface of the electronic device according to various embodiments.

FIG. 1A is a perspective view illustrating a front surface of an electronic device according to various embodiments of the present disclosure. FIG. 1B is a perspective view illustrating a rear surface of the electronic device according to various embodiments of the present disclosure. A Cartesian coordinate system is used, such that an X-axis direction refers to a horizontal direction of the electronic device, a Y-axis direction refers to a vertical direction of the electronic device, and a Z-axis direction refers to a thickness direction of the electronic device.

Referring to FIGS. 1A and 1B, the electronic device 100 according to various embodiments may include a housing 110 serving as an exterior and protecting electronic components. The housing 110 according to various embodiments may include a first surface facing toward a first direction (①), a second surface facing toward a second direction (②) opposite to the first direction (①), and a side surface facing toward a side direction perpendicular to the first and second directions (①, ②), and surrounding at least a portion of a space between the first and second surfaces. The side direction may be a third direction (③) or a fourth direction (④), or may include both the third and fourth directions (③, ④). The first surface of the housing 110 may be formed of a first plate, and the second surface of the housing 110 may be formed of a second plate.

According to various embodiments, when the first direction (①) faces upward, the first surface may be an upper surface of the housing, and, when the second direction (②) faces downward, the second surface may be a rear surface of the housing. For example, when the first direction (①) faces upward, the first surface may be a front surface, and, when the second direction (②) faces downward, the second surface may be a rear surface.

The housing 110 according to various embodiments may include a plurality of side surfaces. For example, the side surfaces may include a side surface formed on an top edge 110*a* of the housing 110, a side surface formed on a bottom edge 110*b* of the housing, a side surface formed on a left edge 110*c* of the housing, and a side surface formed on a right edge 110*d* of the housing. The top edge 110*a*, the bottom edge 110*b*, the left edge 110*c*, and the right edge 110*d* may all constitute a border or a circumference of the electronic device 100.

The electronic device 100 according to various embodiments may include a single display 101. The single display 101 according to various embodiments may include a flat display 101*a* and a curved display 101*b*, 101*c* disposed on at least one edge region of the flat display 101*a*. For example, the display 101 may occupy an area of at least 50% of the housing 110. The display 101 according to various embodiments may include a display module and a transparent member (for example, a glass cover or a transparent window). The display module may include a display panel and a touch panel. The flat display 101*a* and the curved display 101*b*, 101*c* may be formed by a single display module of a flexible type.

First and second curved displays 101*b*, 101*c* may be disposed on a circumferential portion of the flat display 101*a* according to various embodiments, that is, on left and right edges. Although the first and second curved displays 101*b*, 101*c* are disposed on the left and right edges of the flat display 101*a* in the present embodiment, the curved displays are not limited to the above-described positions, and may be disposed on various edge regions.

For example, the curved displays may be disposed on any one of the top edge 110*a*, the bottom edge 110*b*, the left edge 110*c*, the right edge 110*d*, the top and bottom edges 110*a*, 110*b*, the left and right edges 110*c*, 110*d*, and the top, bottom, left, and right edges 110*a*, 110*b*, 110*c*, 110*d*. The top and bottom edges 110*a*, 110*b* without the first and second curved displays 101*b*, 101*c* may include a portion of the housing of a metallic material. For example, a portion of the housing of the metallic material may be an external metal frame, and may be divided by an insulator and may operate as an antenna emitter.

The electronic device 100 according to various embodiments may include a speaker 102 disposed to output a voice of the other person. The electronic device 100 according to various embodiments may include a microphone 103 disposed to transmit a user's voice to the other person. The electronic device 100 may have an opening such that a sound component including the speaker 102 is disposed. The sound component can include a sound component housing, protection member, and sealing member. The sound component can be one of the sound components that are described in FIGS. 3*a*-22.

Although shown on the front cover, the electronic device 100 can have the opening formed on a side surface cover, or rear surface cover 1002.

The electronic device 100 according to various embodiments may have components disposed on the periphery of the speaker 102 to perform various functions of the electronic device 100. The components may include at least one sensor module 104. The sensor module 104 may include at least one sensor of, for example, an illuminance sensor, a proximity sensor, an infrared sensor, an ultrasound sensor, a fingerprint recognition sensor, or an iris recognition sensor. The components according to various embodiments may include a front facing camera device 105. According to various embodiments, the components may include an indicator 106 (for example, a light emitting diode (LED) device) for notifying a user of state information of the electronic device 100.

The electronic device 100 according to various embodiments may include a microphone 103, another speaker 108, an interface connector port 107, and an earjack hole 109. For example, the above-listed components may be disposed on the upper edge or the lower edge of the electronic device.

The electronic device 100 according to various embodiments may include the housing 110. The housing 110 according to various embodiments may be formed of a conductive member or a nonconductive member. The housing 110 may be disposed along the border of the electronic device 100, and may be disposed to extend to a portion of the front surface or at least a portion of the rear surface. The housing 110 may be disposed along the border of the electronic device 100 to define at least a portion of thickness of the electronic device 100, and may be formed a closed loop shape. However, this should not be considered as limiting, and the housing 110 may be formed on at least a portion of the thickness of the electronic device 100. At least a portion of the housing 110 may be built in the electronic device 100.

The electronic device 100 according to various embodiments may include a rear surface window 111 disposed on the second surface (for example, a rear surface) opposite to the first surface. The electronic device 100 according to various embodiments may include a rear facing camera device 112 disposed through the rear surface window 111. According to various embodiments, the electronic device 100 may include at least one electronic component 113 disposed on the periphery of the rear facing camera device 112. According to various embodiments, the at least one electronic component 113 may include at least one of an illuminance sensor, a proximity sensor, an infrared sensor, an ultrasound sensor, a heart rate sensor, a flash device, or a fingerprint recognition sensor.

Figure 2:
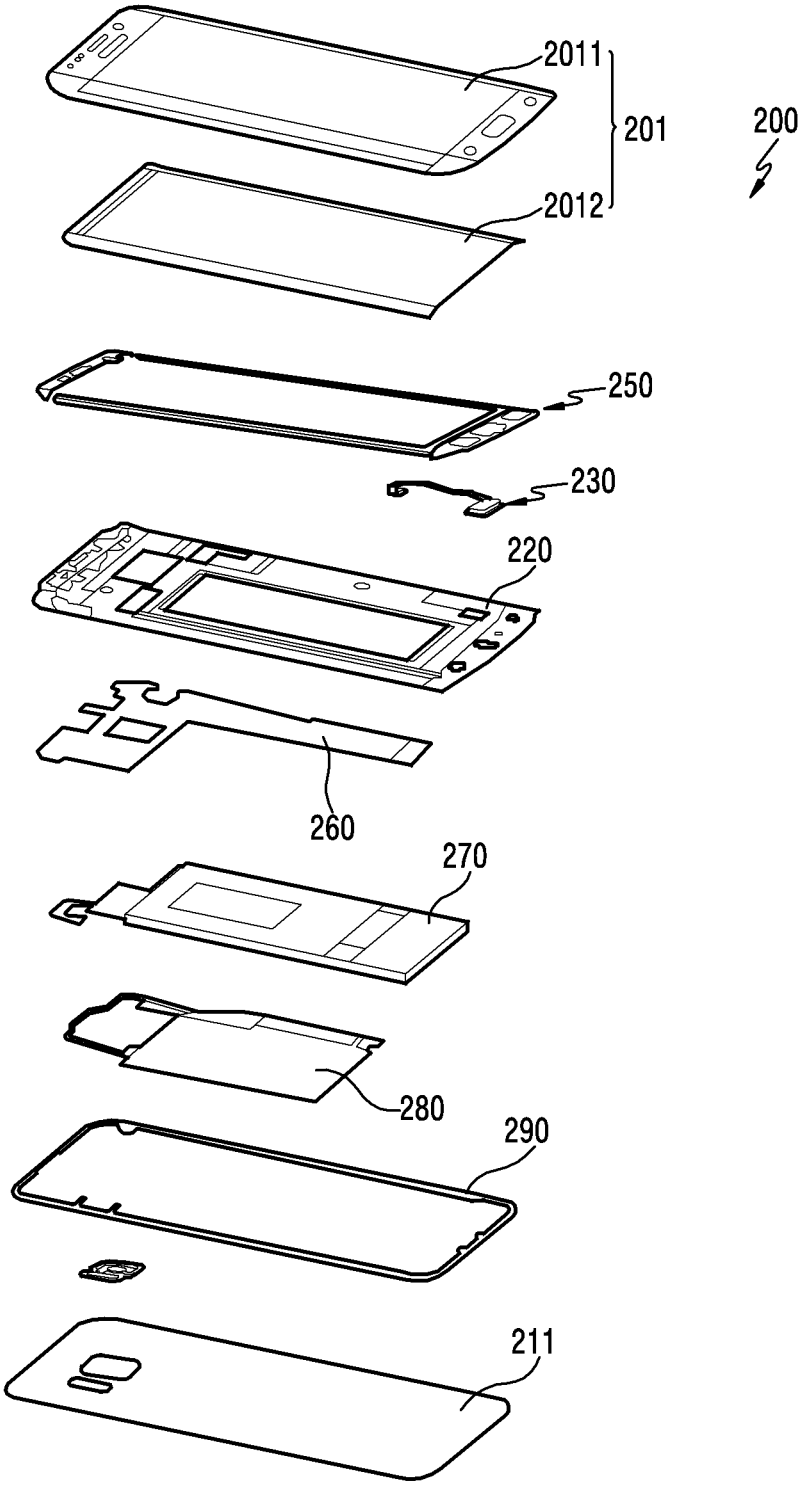
FIG. 2 is an exploded perspective view of an electronic device according to various embodiments.

FIG. 2 is an exploded perspective view of the electronic device according to various embodiments of the present disclosure.

The electronic device 200 of FIG. 2 may be similar to the electronic device 100 of FIGS. 1A and 1B, or may include other embodiments of the electronic device.

Referring to FIG. 2, the electronic device 200 (for example, the electronic device 100) according to various embodiments may include a key input device 230, at least one sealing member 250, and a display 201 including a display module 2012 and a window 2011, which are arranged in sequence on the upper side with reference to the housing 220. The electronic device 200 according to various embodiments may include a printed circuit board 260 (for example, a PCB, an FPC, or a main board), a rechargeable battery 270, a wireless power transmission and reception member 280, a rear surface sealing member 290, and a rear surface window 211, which are arranged in sequence on the lower side with reference to the housing 220. The rechargeable battery 270 according to various embodiments may be received in a receiving space formed on the housing 220, and may be disposed to avoid the printed circuit board 260. The rechargeable battery 270 and the printed circuit board 260 according to various embodiments may be disposed in parallel without overlapping each other. However, this should not be considered as limiting, and the rechargeable battery 270 may be disposed to have at least a portion thereof overlapping the printed circuit board 260.

In an example embodiment of the present disclosure according to various embodiments, the housing 220 is solitarily used, but may be used with at least one plate (for example, a middle plate, a rear plate, or a separable battery cover) coupled with the housing 220. The housing 220 according to various embodiments may be formed by using a conductive member (for example, a metal member or the like) and a nonconductive member (for example, a resin or the like). The housing 220 according to various embodiments may be formed by performing insert-injection molding or double-shot injection molding with respect to the conductive member and the nonconductive member.

The display 201 according to various embodiments may be assembled with the housing 220 after the display module 2012 is attached to the rear surface of the window 2011. The window 2011 according to various embodiments may be formed by a transparent material such as glass or resin. The display module 2012 according to various embodiments may include a touch sensor. The display module according to various embodiments may include a touch sensor and a force sensor. The electronic device 200 according to various embodiments may include the at least one sealing member 250 disposed between the housing 220 and the display 201 for a waterproof purpose.

The electronic device 200 according to various embodiments may include the rear surface seal member 290 disposed between the rear surface of the housing 220 and the rear surface window 211 along the border of the electronic device 200 for a waterproof purpose. The rear surface window 211 according to various embodiments may be formed by at least one material such as glass, plastic, complexing resin, or metal. The sealing member 250, 290 according to various embodiments may include at least one of a tape, an adhesive, waterproof dispensing, silicon, waterproof rubber, and urethane.

The printed circuit board 260 according to various embodiments may include a memory, a processor, various sensors, or an input and output terminal, and may perform various functions of the electronic device by using power supplied from the rechargeable battery 270. The printed circuit board 260 according to various embodiments may be disposed adjacent to the rechargeable battery 270. The printed circuit board 260 according to various embodiments may be disposed to have one surface contacting one surface of the rechargeable battery 270 and to overlap the battery 270 at least in part, or may be formed in the shape of "¬" or "⊏" to avoid the disposal space of the rechargeable battery 270, and may be disposed to share the same plane with the rechargeable battery 270.

The rechargeable battery 270 according to various embodiments may supply power to main components such as the display 201, the printed circuit board 260, or the like, and may provide a seating plane for the wireless power transmission and reception member 280 or various sheet types of sensors. The rechargeable battery 270 may be disposed in a seating space (cavity) formed on a portion of the housing 220 or in a battery pack mounting region guaranteeing a predetermined space due to a guide rib in order to achieve stable assembly and to prevent a movement during use due to a volume and a weight thereof. The rechargeable battery 270 according to various embodiments may be used as a built-in battery pack built in the electronic device 200, or may be removed from the electronic device by opening a battery cover for the purpose of replacement.

The rechargeable battery 270 according to various embodiments may include a battery pouch having a battery cell wound therein, a protective circuit module (PCM) (for example, a printed circuit board) electrically connected with a terminal drawn from the battery pouch, and a case (for example, a PCM housing or a PCM case) for protecting the PCM. The case receiving the PCM according to various embodiments may be fixed to the battery pouch as an assembly structure for enhancing shock resistance. Accordingly, damage to elements of the rechargeable battery (for example, the battery pouch, the PCM or a terminal) can be prevented even in response to an external shock to the electronic device.

Figure 3A:
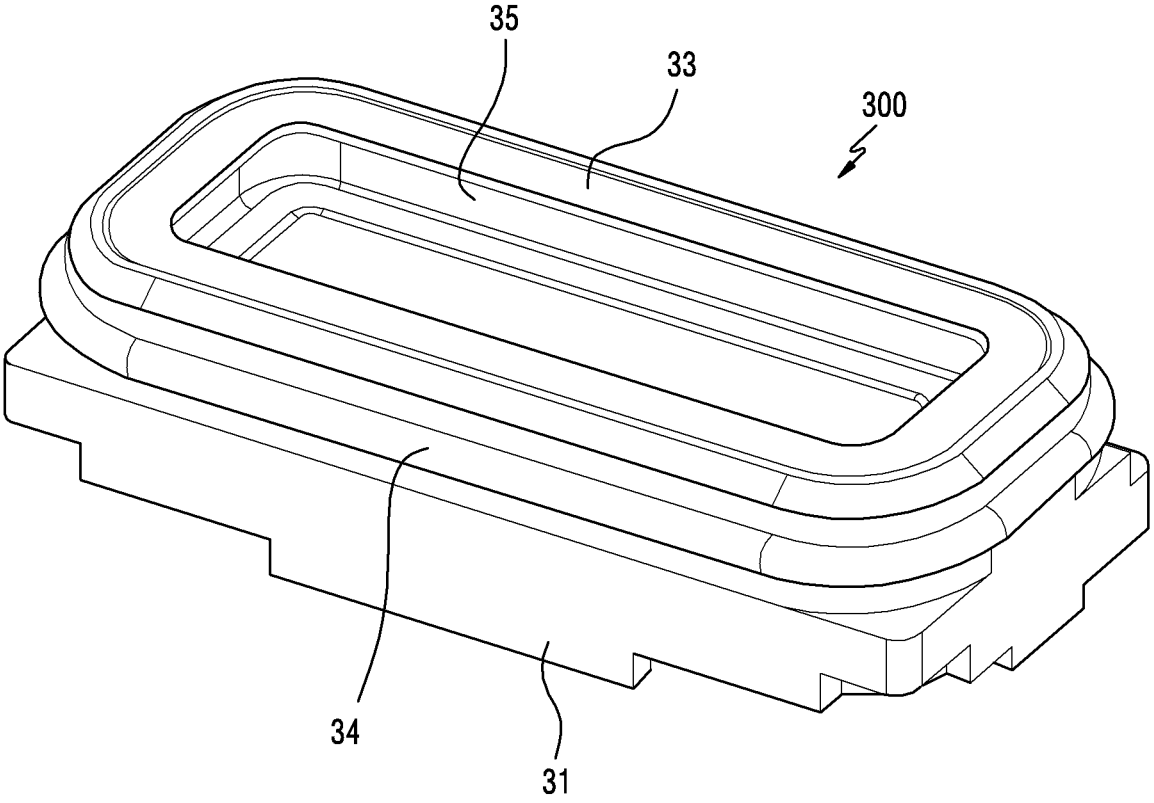
FIG. 3A is a perspective view illustrating a configuration of a sound component according to a related-art embodiment.
Figure 3B:
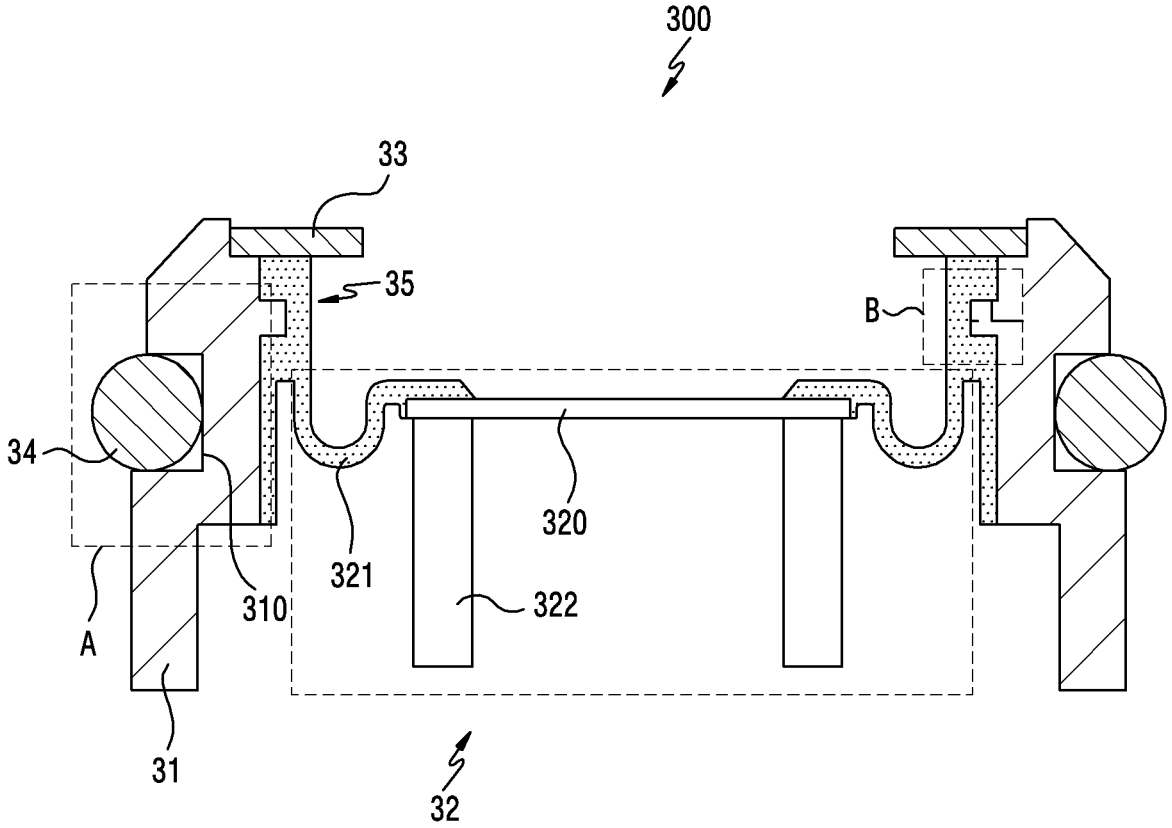
FIG. 3B is a cross sectional view.
Figure 4A:
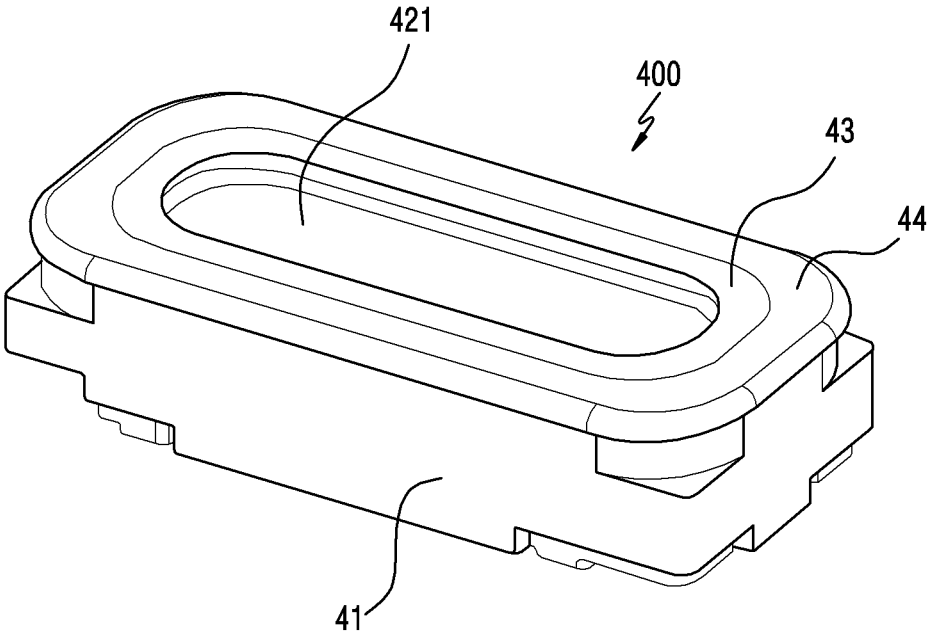
FIG. 4A, FIG. 4B, FIG. 4C, FIG. 4D and FIG. 4E are cross sectional views illustrating configurations of other sound components according to various embodiments.
Figure 4B:
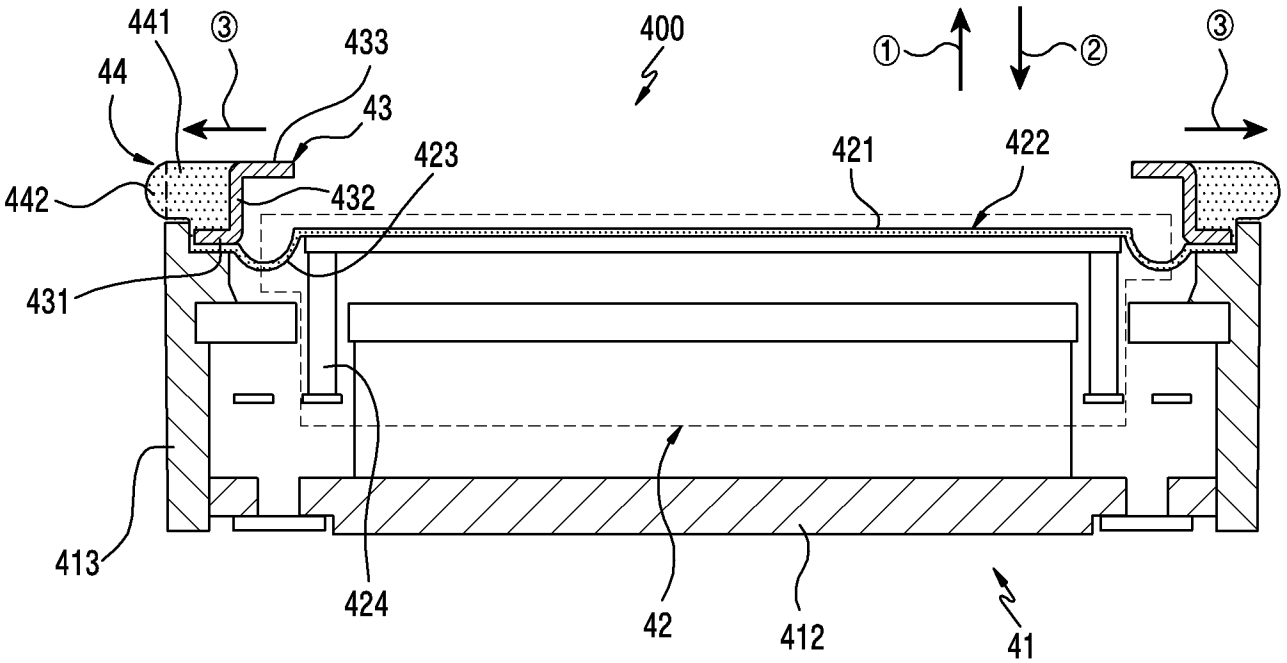
Figure 4C:
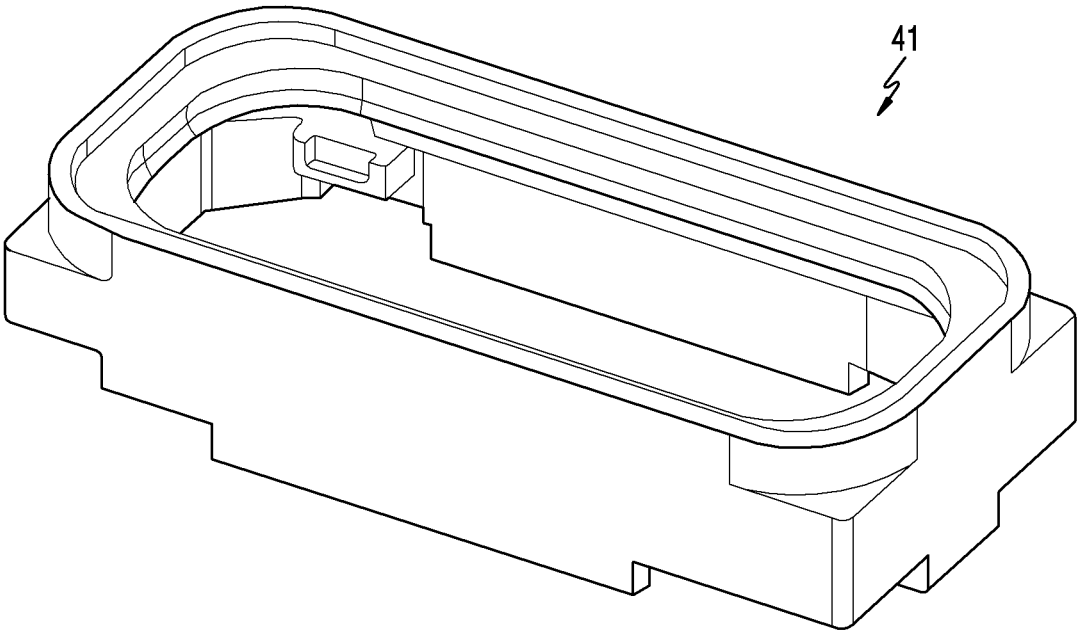
Figure 4D:
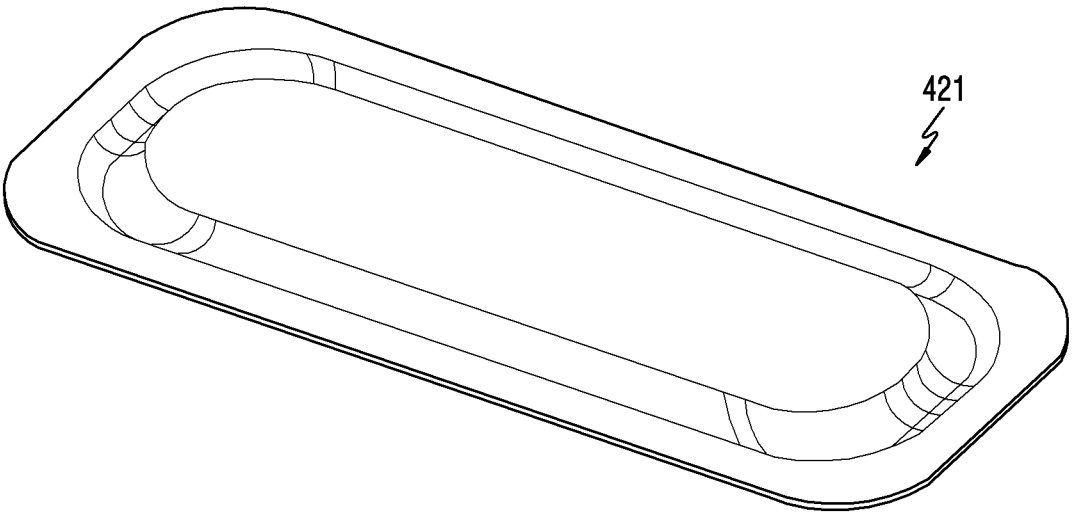
Figure 4E:
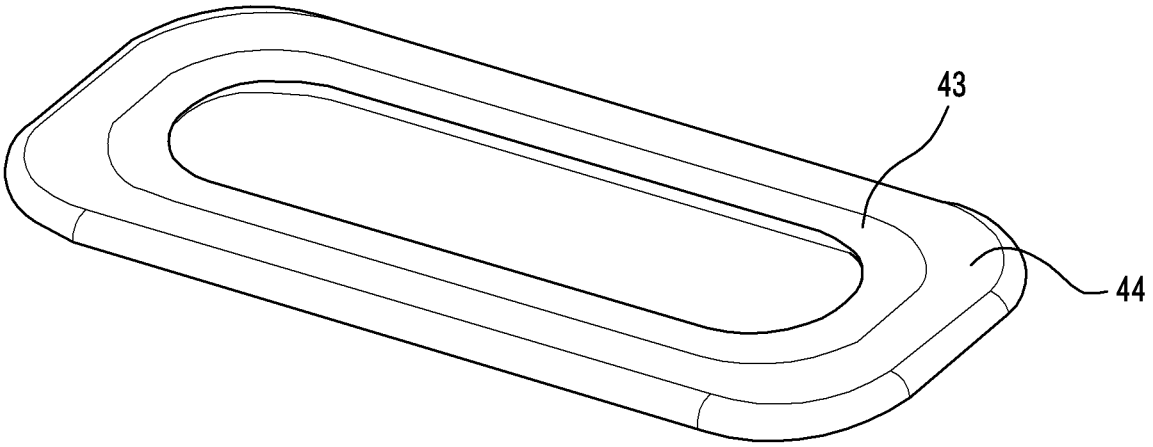

Referring to FIGS. 3A and 3B, a sound component 300 according to a related-art embodiment may be provided with a grill 33 and a waterproof structure to protect a speaker 32 mounted in a sound component housing 31 from the outside. For example, the sound component 300 may be formed of a portion in the box marked by A (A portion) and a portion in the box marked by B (B portion) as a waterproof structure. The A portion may include a recess 310 formed on the sound component housing 31 and an O-ring 34 received in the recess 310. The B portion may be formed of a coupling structure of a recess and a protrusion. The O-ring 34 used as a waterproof component may be made of a rubber material, and may be coupled to the housing of the electronic device by press-fitting, and may serve as a structure for preventing moisture penetration into the electronic device having the sound component 300 mounted therein.

A vibration portion coupler 35 may be disposed to couple the speaker 32 to the sound component housing 31 (for example, a frame) so that vibrations from the speaker 32 cause the frame (e.g., the sound component housing) 31 to similarly vibrate. The vibration portion coupler 35 may be formed by a soft material such as a silicon rubber material, and may be integrally formed with the sound component housing 31 by double-shot injection molding, and may support first and second vibration portions 320, 321 of the speaker 32 in a suspension type structure. For example, the first vibration portion 320 may include a center dome portion, and the second vibration portion 321 may include a side dome portion. Reference numeral 322 may indicate a coil, which is a portion of the speaker 32. For example, the vibration portion coupler 35 may be formed by coupling a recess formed on a portion of the second vibration portion 321 and a protrusion formed on the housing 31 to each other.

However, the thickness may increase due to a mounting structure of the A portion, that is, the O-ring structure 34. This structural problem may result in reduction in a space where the speaker 32 is positioned and may result in deteriorating sound quality.

Hereinafter, a configuration of a sound component according to various embodiments of the present disclosure will be described with reference to the accompanying drawings.

Referring to FIGS. 4A to 4E, a sound component 400 according to various embodiments is at least one component that is mounted in an electronic device (for example, the electronic device 100 or 200), and may be sealed to emit a sound toward a front surface, a rear surface, or a side surface of the electronic device. The sound component 400 may be sealed to face the front surface, the rear surface, or the side surface of the electronic device. For example, the sound component 400 may include the speaker 102 illustrated in FIG. 1A or the speaker 108 illustrated in FIG. 1A. For example, the electronic device may include a smart phone, a tablet PC, or a wearable device.

The sound component 400 can include a housing. The housing can comprise a first plate that can be formed of protection member 43 and first vibration portion 421 facing a first direction (1), a second plate which can be a bottom portion 412 facing a second direction (2) opposite the first direction, a third plate, which can be a side surface frame 413 facing a third direction perpendicular to the first and second directions. A speaker 42 can be disposed in the housing and configured to generate sound. A protection member 43 is mounted to be exposed through the first plate in the first direction and protects the speaker 42. A sealing member 44 is disposed between the housing and the protection member. The protection member 43 and the sealing member 44 can be integrally formed with each other.

The sound component 400 according to various embodiments may include a sound component housing 41, a speaker 42, a protection member 43, and a sealing member 44. The sound component housing 41 may receive and protect the speaker 42 with the protection member 43. The protection member 43 may be a cover that allows a sound of the speaker 42 to pass therethrough, but protects the speaker 42 from the outside. The sealing member 44 may be a member of an elastic material that has a waterproof structure to prevent intrusion of foreign substances, for example, moisture, into the electronic device. The protection member 43 and the sealing member 44 may be integrally formed with each other by double-shot injection molding, and may be coupled to the housing for the sound component 41. The protection member 43 and the sealing member 44 may be formed by different kinds of materials. The protection member 43 may be formed by a rigid material, for example, a metallic material such as steel use stainless (SUS), whereas the sealing member 44 may be formed by a flexible material, for example, liquid silicon rubber (LSR), silicon, rubber, or the like.

The housing for the sound component 41 according to various embodiments may include a first plate facing toward a first direction, a second plate facing toward a second direction opposite to the first direction, and a third plate facing toward a third direction perpendicular to the first and second directions. For example, at least a portion of the first plate may be the protection member 43 (see FIG. 4E), at least a portion of the second plate may be a bottom portion 412 of the sound component housing 41, and at least a portion of the third plate may be a side surface frame 413 of the sound component housing. In certain embodiments, the first plate can be formed by protection member 43 and first vibration portion 421.

The speaker 42 according to various embodiments may be disposed in the housing for the sound component 41 to generate a sound in the first direction. For example, the speaker 42 may include a vibration portion 422. The vibration portion 422 may include first and second vibration portions 421, 423. For example, the first vibration portion 421 may be a center dome portion and may have a plate shape, and may be referred to as a vibration plate, and the second vibration portion 423 may be a side dome portion and may include at least one curved portion. The vibration portion 422 may be a portion of the speaker 42, and may be disposed to face the bottom portion 412, spaced apart therefrom, and may do a vibration motion. The vibration portion 422 may be formed by the same material as that of the sealing member 44, or may be formed by a different material. When the vibration portion 422 is formed by the same material as that of the sealing member 44, the vibration portion 422 and the sealing member 44 may be integrally formed with each other by injection molding. Reference numeral 422 indicates a coil, which is a portion of the speaker 42.

The speaker 42 according to various embodiments is an operating portion for reproducing a sound, and may include a side dome and a center dome (not shown), and other coil portions, a plate and a magnet may include a magnetic field closed circuit. The coil portions or plate can be varied in a variety of ways. Additionally, a variety of different types of coils can be used as well as a variety of suspension applied portions.

The protection member 43 according to various embodiments may be mounted to be exposed through at least a portion of the first plate in the first direction, and may protect the speaker 42.

The protection member 43 according to various embodiments may be formed by a metallic material, and may include a grill formation (for example, a mesh member) provided on a thin film plate. The protection member 43 may be included with a grill formation to provide the sound emitted from the speaker 42 as well as prevent intrusion of foreign substances into the speaker 42 from the outside. The foreign substances may include dust or moisture. The metallic material may include a SUS material.

The protection member 43 according to various embodiments may include first, second, and third portions. The first portion 431 according to various embodiments may be in contact with at least a portion of the sealing member 44, and may be extended in the third direction, and may face the housing for the sound component 41. The second portion 432 according to various embodiments may be bent from an end of the first portion 431 at substantially (or within 5 degrees) a right angle and may be extended in the first direction, and may be in contact with at least a portion of the sealing member 44. The third portion 433 according to various embodiments may be bent from an end of the second portion 432 at substantially (or within 5 degrees) a right angle and may be extended in the third direction. For example, a sealing body 441 of the sealing member may be in contact with an opening space provided by the first and second portions 431, 432 of the protection member 43.

The sealing member 44 according to various embodiments may provide a waterproof structure for the sound component 400, and may be a coupling member integrally coupled with the vibration portion 422. Therefore, the sealing member 44 may be formed by a material capable of performing a double function. The sealing member 44 according to various embodiments may be disposed on the protection member 43, and may also be formed to surround an outer surface of the protection member 43.

The sealing member 44 according to various embodiments may include a first sealing portion 442 protruding in the third direction. The first sealing portion 442 may be configured to have elasticity enough to prevent intrusion of foreign substances when being coupled to a cover (for example, a front surface cover, a rear surface cover, or a frame) of the electronic device. The first sealing portion 442 may be disposed to be in contact with the front surface cover, the rear surface cover or the side surface cover of the electronic device, and may be disposed in a pressed state to remove a gap through which foreign substances may enter. For example, the sealing portion 442 according to various embodiments may have a substantially semicircular or trapezoidal cross section (see FIG. 7).

The sealing member 44 according to various embodiments may include the sealing body 441 and the sealing portion 442. The sealing body 441 according to various embodiments may be disposed in contact with the first and second portions 431, 432 of the protection member. The sealing portion 442 according to various embodiments may be integrally formed with the sealing body 441 by injection molding, and may protrude from the sealing body 441 in the third direction.

The sealing member 44 according to various embodiments may be disposed in contact with the front surface, the side surface, the rear surface, or any one of the front surface and the side surface of the electronic device in a pressed state, and may provide a waterproof structure of the electronic device having the sound component mounted therein.

Figure 5:
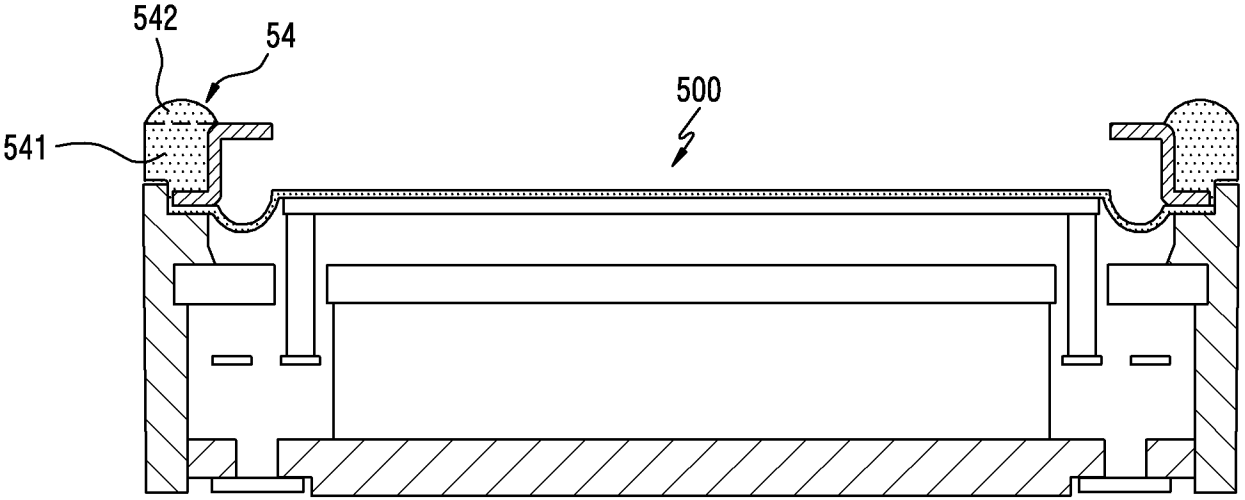
FIG. 5, FIG. 6, FIG. 7, FIG. 8 and FIG. 9 are cross sectional views illustrating configurations of other sound components according to various embodiments.

Referring to FIG. 5, a sound component 500 according to various embodiments differs from the sound component 400 illustrated in FIGS. 4A to 4E in the protruding direction of the sealing portion 542, and is the same as the sound component 400 in other configurations. Therefore, the other configurations will not be described in detail to avoid a redundant description thereof.

A sealing member 54 according to various embodiments may further include a sealing portion 542 protruding in the first direction. The sealing member 54 according to various embodiments may include a sealing body 541 and the sealing portion 542. The sealing portion 542 may protrude from the surface of the third plate to face toward the first direction, and may be in contact with a front surface, a side surface, or a rear surface of an electronic device (not shown) in a pressed state, and may serve as a waterproof structure to prevent intrusion of foreign substances into the electronic device having the sound component mounted therein.

The sealing member 54 surrounds an outer surface of the protection member.

Figure 6:
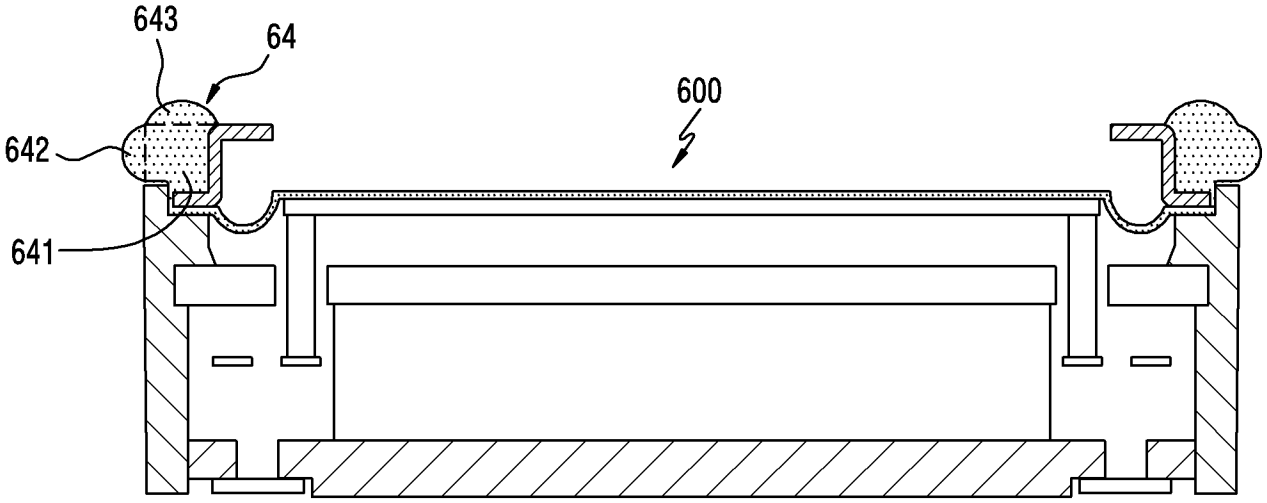

Referring to FIG. 6, a sound component 600 according to various embodiments differs from the sound component 400 illustrated in FIGS. 4A to 4E in the sealing portion, and is the same as the sound component 400 in other configurations. Therefore, the other configurations will not be described in detail to avoid a redundant description thereof.

A sealing member 64 according to various embodiments may include a first sealing portion 642 protruding in the third direction, and a second sealing portion 643 protruding in the first direction. The sealing member 64 according to various embodiments may include a sealing body 641, the first sealing portion 642, and the second sealing portion 643. The sealing member 64 may be in contact with a front surface and a side surface or a rear surface and a side surface of an electronic device (not shown) in a pressed state, and may serve as a waterproof structure to prevent intrusion of foreign substances into the electronic device having the sound component mounted therein.

Figure 7:
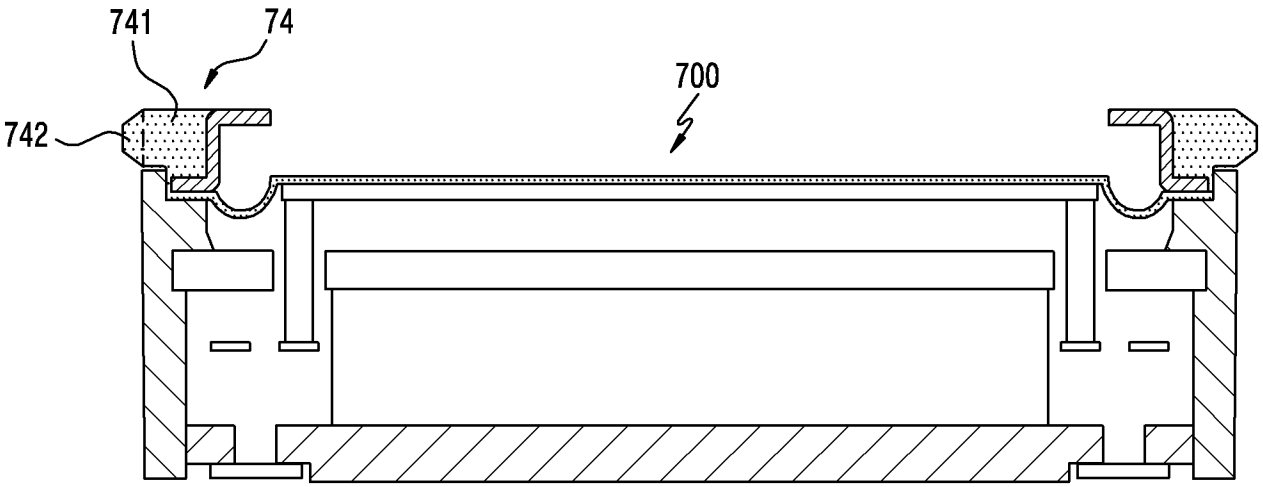
Figure 8:
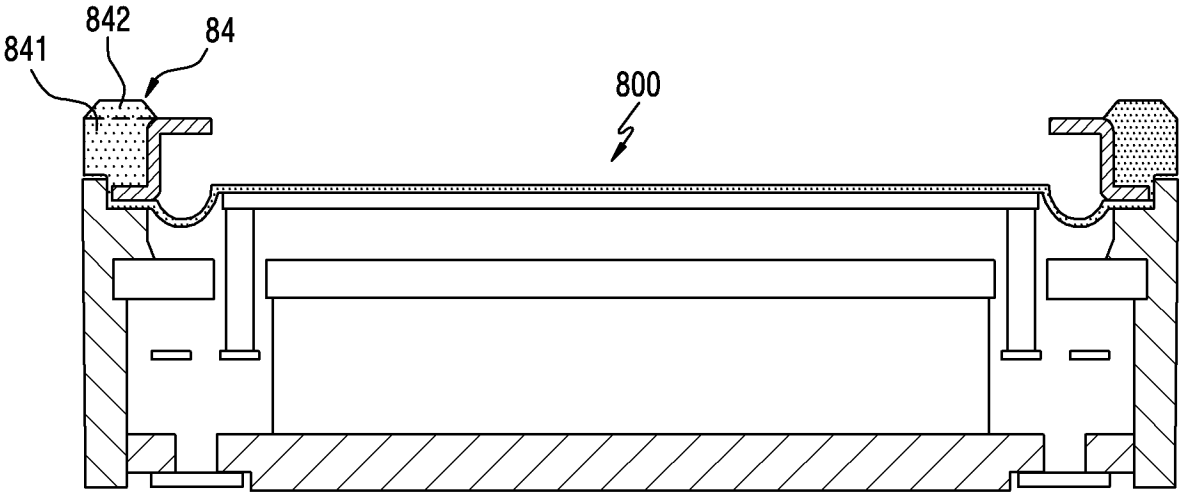
Figure 9:
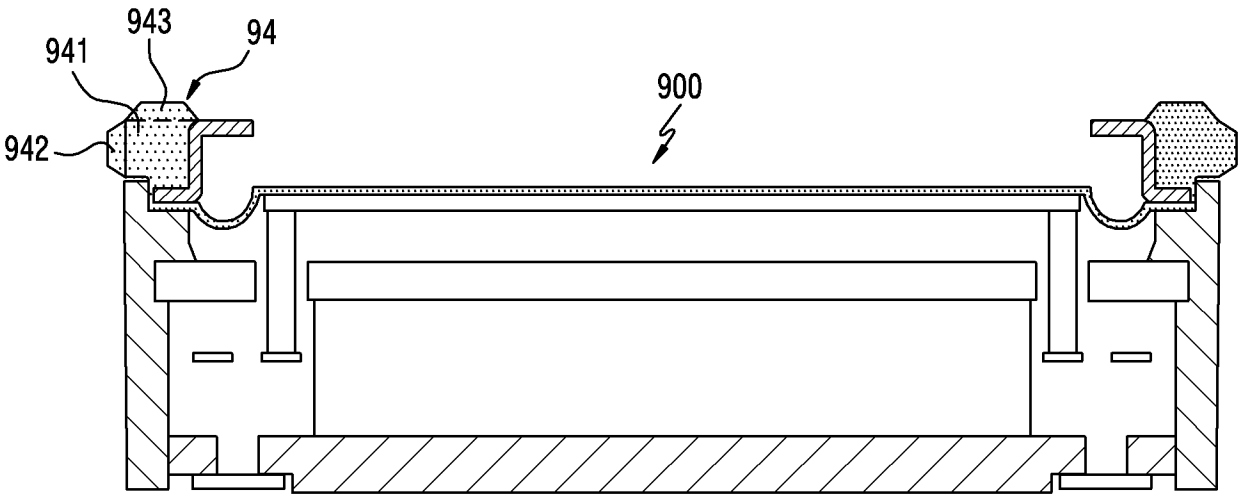
Figure 10A:
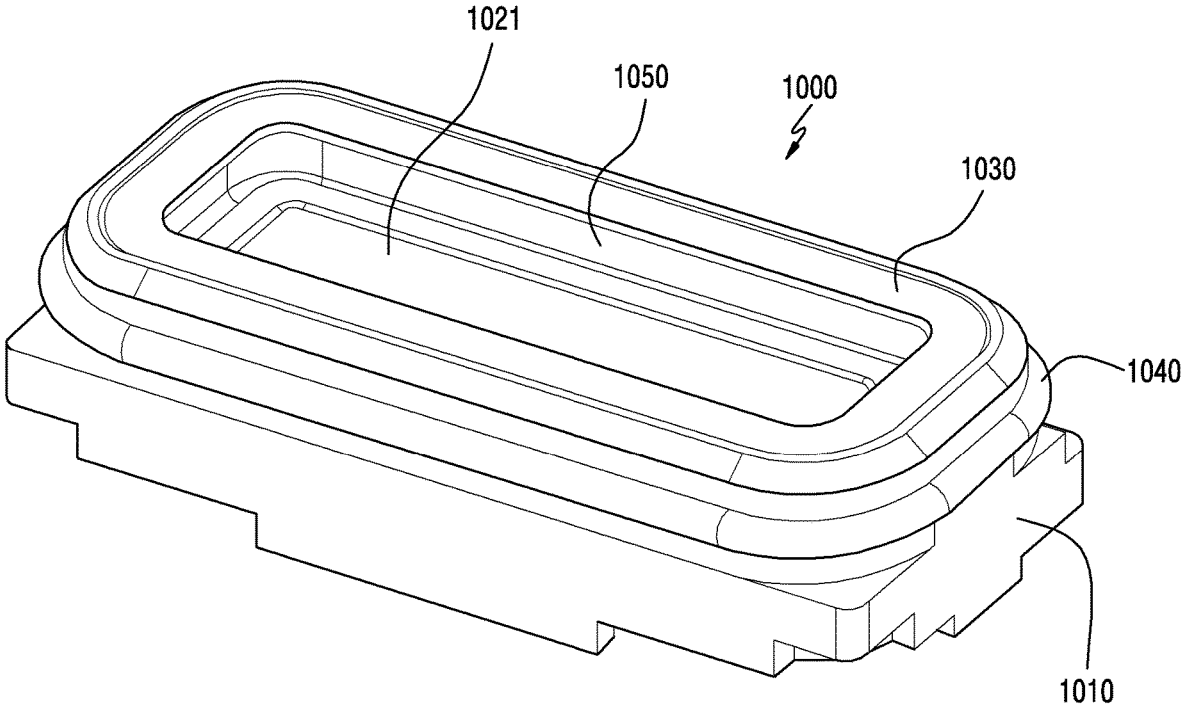
FIG. 10A, FIG. 10B, FIG. 10C, and FIG. 10D are views illustrating configurations of other sound components according to various embodiments.
Figure 10B:
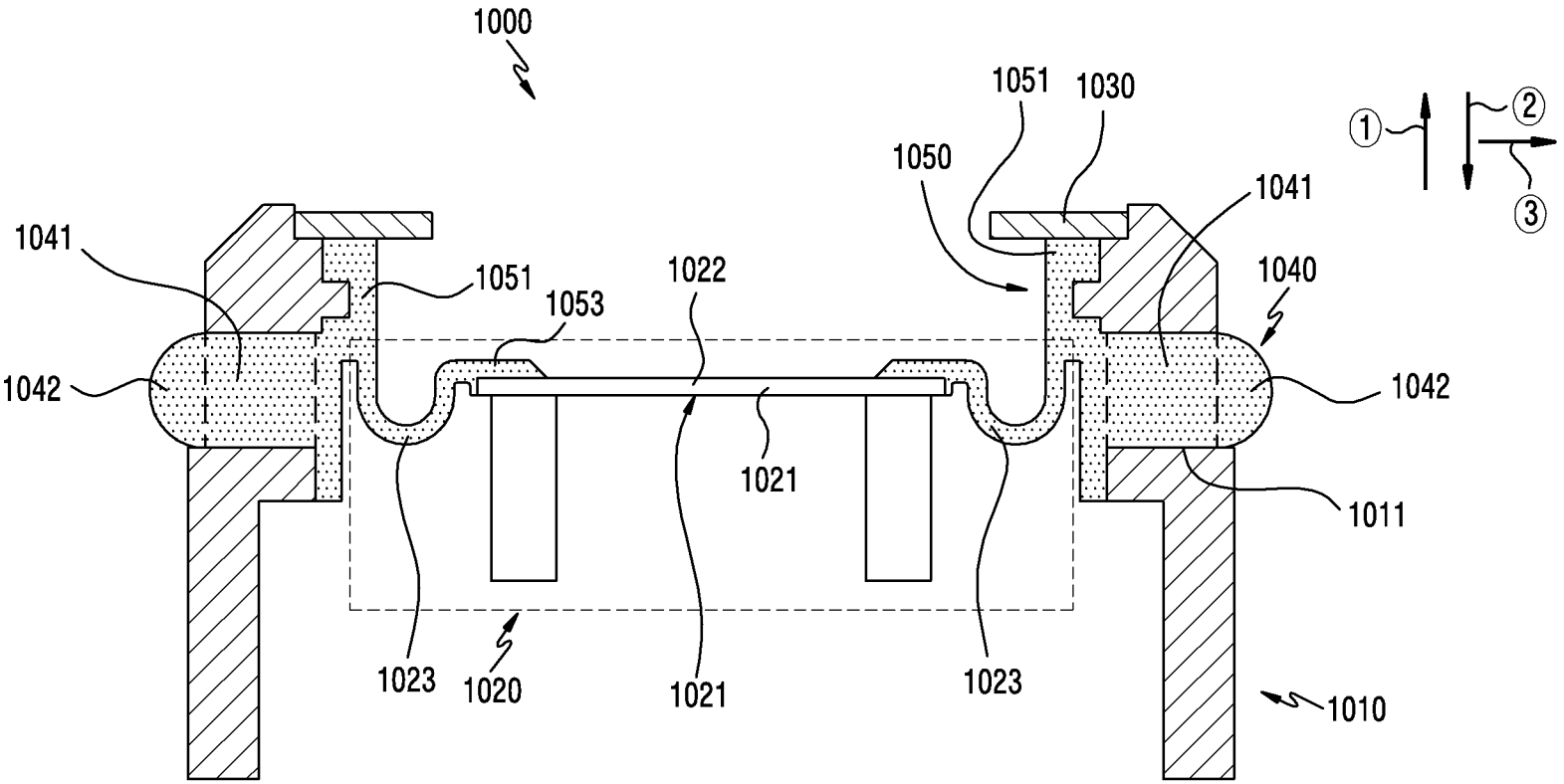
Figure 10C:
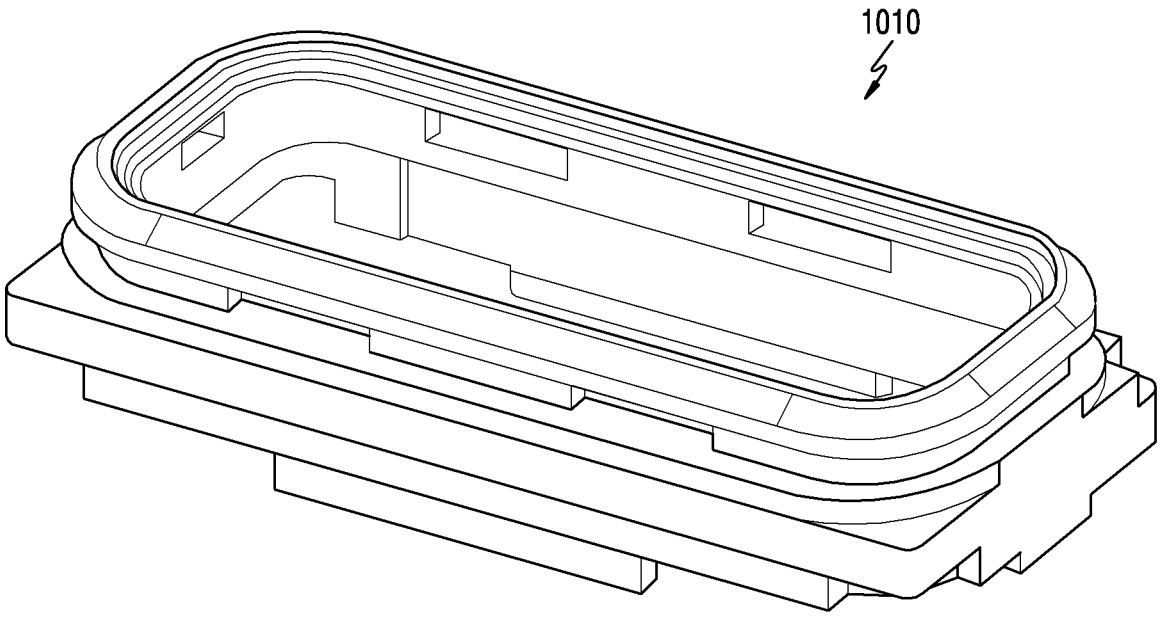
Figure 10D:
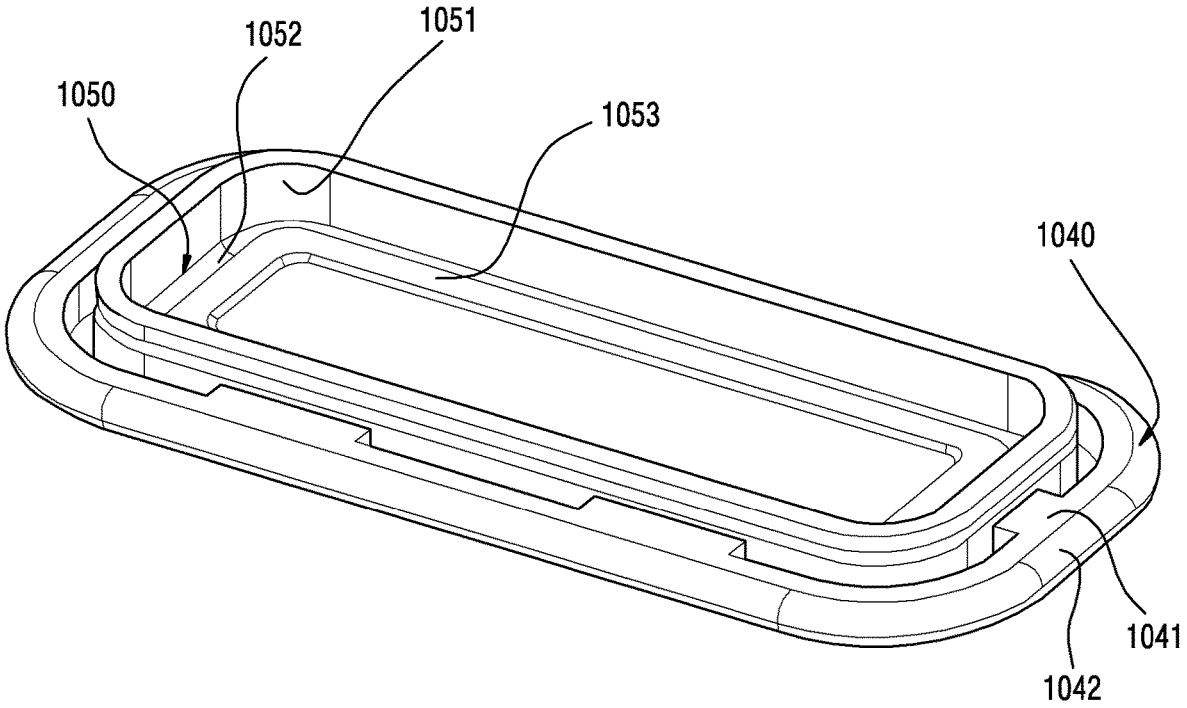

The first sealing portion 542 and 642 have a substantially semicircular cross section. In FIGS. 7-9, the first sealing portion 742 can have a trapezoidal cross section.

Referring to FIG. 7, a sound component 700 according to various embodiments differs from the sound component 400 illustrated in FIGS. 4A to 4E in the shape of the sealing portion, and is the same as the sound component 400 in other configurations. Therefore, the other configurations will not be described in detail to avoid a redundant description thereof.

A sealing member 74 according to various embodiments may further include a sealing portion 742 protruding in the third direction. The sealing member 74 according to various embodiments may include a sealing body 741 and the sealing portion 742, and the sealing portion 742 may have a trapezoidal (for example, an isosceles trapezoid) cross section. The sealing member 74 may be in contact with a front surface, a side surface or a rear surface of an electronic device (not shown) in a pressed state, and may serve as a waterproof structure to prevent intrusion of foreign substances into a speaker.

Referring to FIG. 8, a sound component 800 according to various embodiments differs from the sound component 500 illustrated in FIG. 5 in the shape of the sealing portion, and is the same as the sound component 500 in other configurations. Therefore, the other configurations will not be described in detail to avoid a redundant description thereof.

A sealing member 84 according to various embodiments may further include a sealing portion 842 protruding in the first direction. The sealing member 84 according to various embodiments may include a sealing body 841 and the sealing portion 842, and the sealing portion 842 may have a trapezoidal (for example, an isosceles trapezoid) cross section. The sealing member 84 may be in contact with a front surface, a side surface, or a rear surface of an electronic device (not shown) in a pressed state, and may serve as a waterproof structure to prevent intrusion of foreign substances into the electronic device having the sound component mounted therein.

Referring to FIG. 9, a sound component 900 according to various embodiments differs from the sound component 600 illustrated in FIG. 6 in the shape of the sealing portion, and is the same as the sound component 600 in other configurations. Therefore, the other configurations will not be described in detail to avoid a redundant description thereof.

A sealing member 94 according to various embodiments may include a first sealing portion 942 protruding in the third direction, and a second sealing portion 943 protruding in the first direction. The sealing member 94 according to various embodiments may include a sealing body 941, the first sealing portion 942 and the second sealing portion 943. The first sealing portion 942 may have a trapezoidal (for example, an isosceles trapezoid) cross section, and the second sealing portion 943 may have a trapezoidal (for example, an isosceles trapezoid) cross section. The sealing member 94 may be in contact with a front surface and a side surface or a rear surface or a side surface of an electronic device (not shown) in a pressed state, and may serve as a waterproof structure to prevent intrusion of foreign substances into the electronic device having the sound component mounted therein.

Referring to FIGS. 10A to 10D, a sound component 1000 according to various embodiments is at least one component that is configured to be mounted in an electronic device, and may be sealed to face any one of a front surface, a rear surface, or a side surface of the electronic device. The sound component 1000 may be sealed to emit a sound toward the front surface, the rear surface, or the side surface of the electronic device. For example, the sound component 1000 may include a receiver or a speaker.

The sound component 1000 according to various embodiments may include a sound component housing 1010, a speaker 1020, a protection member 1030, a sealing member 1040, and a vibration portion coupler 1050. The sound component housing 1010 may receive and protect the speaker 1020 with the protection member 1030. The protection member 1030 may be a cover that allows a sound of the speaker 1020 to pass therethrough, but protects the speaker from the outside. The sealing member 1040 may be a member of an elastic material that has a waterproof structure to prevent intrusion of foreign substances into the electronic device having the sound component mounted therein.

The sealing member 1040 and the vibration portion coupler 1050 according to various embodiments may be integrally formed with each other by double-shot injection molding, and may be coupled to the sound component housing 1010. The protection member 1030 and the sealing member 1040 may be formed by different kinds of materials. The protection member 1030 may be formed by a rigid material, for example, a metallic material such as SUS, whereas the sealing member 1040 and the vibration portion coupler 1050 may be formed by a flexible material, such as LSR, silicon, rubber, or the like.

The sound component housing 1010 according to various embodiments may include a first plate facing toward a first direction, a second plate facing toward a second direction opposite to the first direction, and a third plate facing toward a third direction perpendicular to the first and second directions. For example, at least a portion of the first plate may be the protection member 1030, at least a portion of the second plate may be a bottom portion, and at least a portion of the third plate may be a side surface frame.

The speaker 1020 according to various embodiments may be disposed in the sound component housing 1010 to generate a sound in the first direction. For example, the speaker 1020 may include a vibration portion 1021. The vibration portion 1021 may include first and second vibration portions 1022, 1023. For example, the first vibration portion 1022 may be a center dome portion and may have a plate shape, and may be referred to as a vibration plate, and the second vibration portion 1023 may be a side dome portion and may include a curved portion. The vibration portion 1021 may be a portion of the speaker 1020, and may do a vibration motion.

The protection member 130 according to various embodiments may be mounted to be exposed through at least a portion of the first plate in the first direction, and may protect the speaker 1020. The protection member 1030 according to various embodiments may be formed by a metallic material, and may include a grill formation (for example, a mesh member) provided on a thin film plate. The protection member 1030 may be provided with a grill formation to discharge the sound emitted from the speaker 1020 to the outside, and to prevent intrusion of foreign substances into the speaker from the outside. The foreign substances may include dusts or moisture. The metallic material may include a SUS material.

The sealing member 1040 according to various embodiments may be coupled with the sound component housing 1010, and may be integrally coupled with the vibration portion coupler 1050. For example, the sealing member 1040 may be forcedly inserted into an opening 1011 formed on the sound component housing in the third direction, and may be coupled thereto. The opening 1011 may be extended in the third direction.

The sealing member 1040 according to various embodiments may include a sealing body 1041 inserted into the sound component housing 1010, and a sealing portion 1042 integrally formed with the sealing body 1041 by injection molding and protruding in the third direction. For example, the sealing body 1041 and the sealing portion 1042 are the same as the sealing body 1041 and the sealing portion 442 illustrated in FIG. 4B, and thus a detailed description thereof is omitted.

The vibration portion coupler 1050 according to various embodiments is a coupling device for coupling the speaker 1020 to the sound component housing 1010, and may couple the sealing body 1041 and the vibration portion 1021 therebetween. The sealing member 1040 and the vibration portion coupler 1050 may be integrally formed with each other by double-shot injection molding. The vibration portion coupler 1050 according to various embodiments may be coupled to a portion of the sound component housing 1010, and may include a first portion 1051 integrally formed with the sealing body 1041 by injection molding. At least a portion of the vibration portion coupler 1050, for example, the first portion 1051, may be coupled with the protection member 1030.

Referring to FIGS. 11A to 11D, a sound component 1100 according to various embodiments is the same as the sound component 1000 illustrated in FIGS. 10A to 10D in other configurations except for a coupling structure of a sound component housing 1110 and a sealing member 1140, and thus the other configurations will not be described in detail to avoid a redundant description thereof.

At least a portion of the sound component housing 1110 according to various embodiments, and the sealing member 1140 may be integrally formed with each other by double-shot injection molding.

Figure 11A:
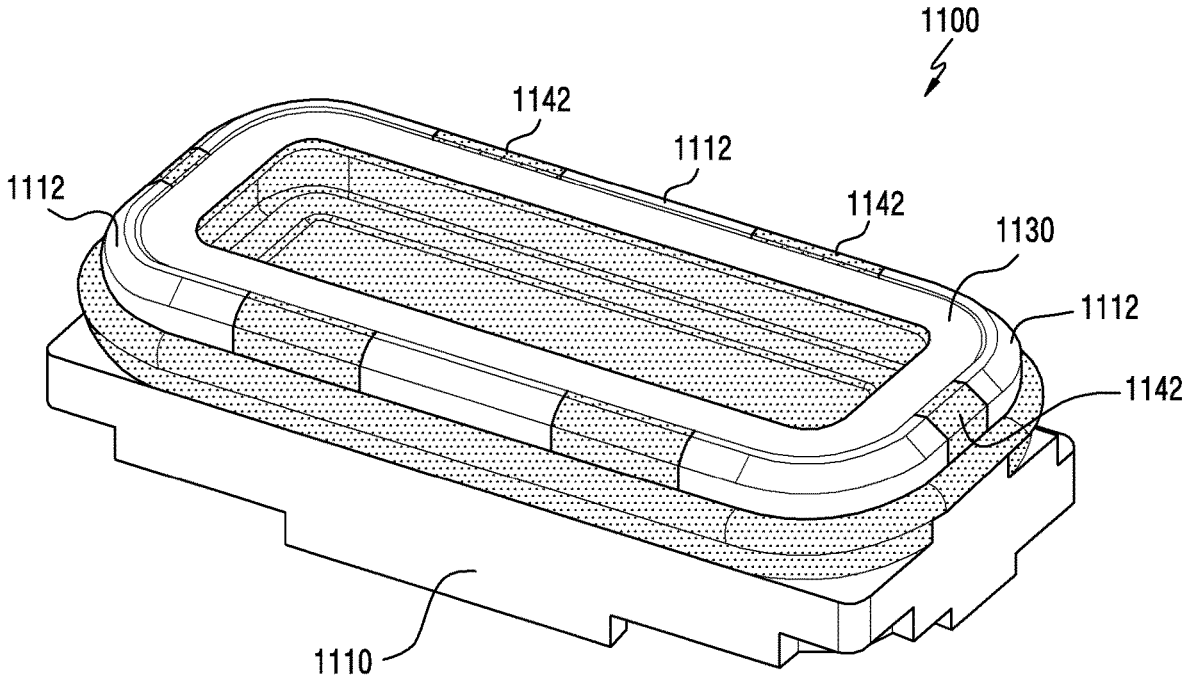
FIG. 11A, FIG. 11B, FIG. 11C and FIG. 11D are views illustrating configurations of other sound components according to various embodiments.
Figure 11B:
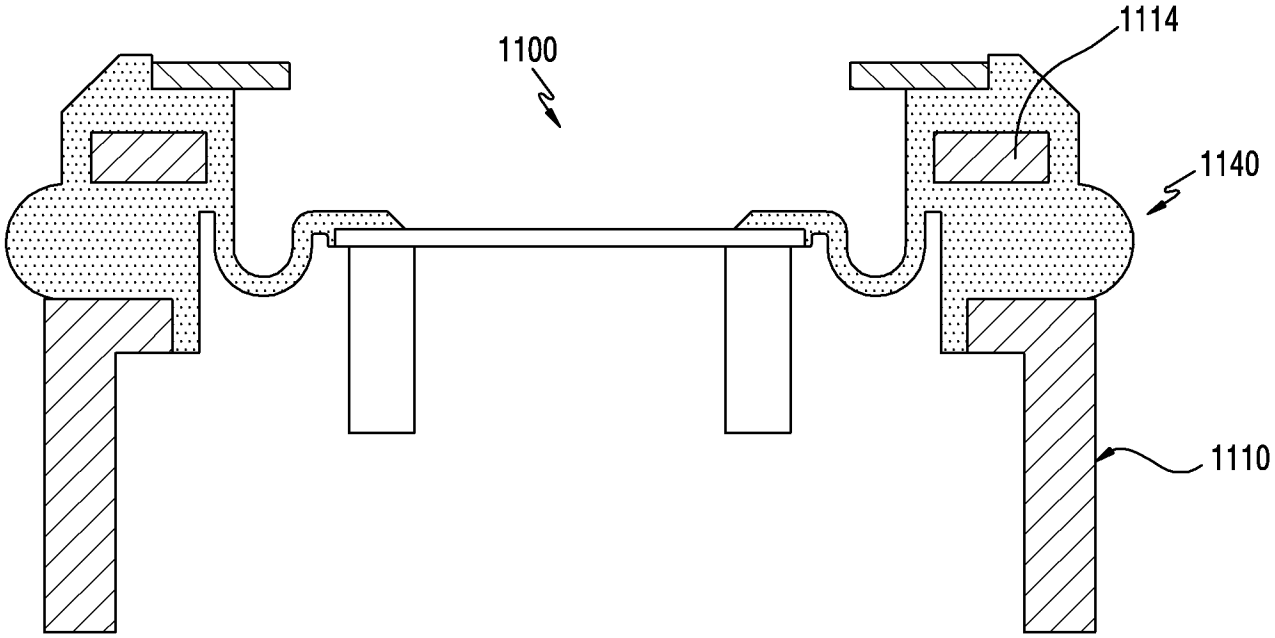
Figure 11C:
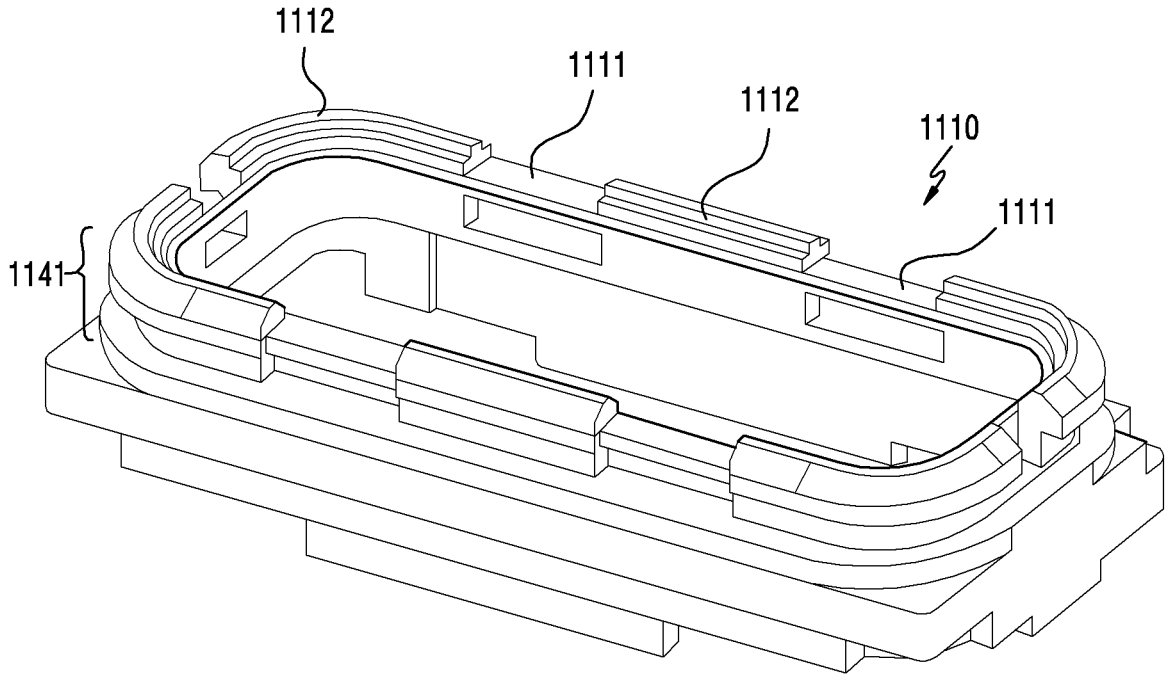
Figure 11D:
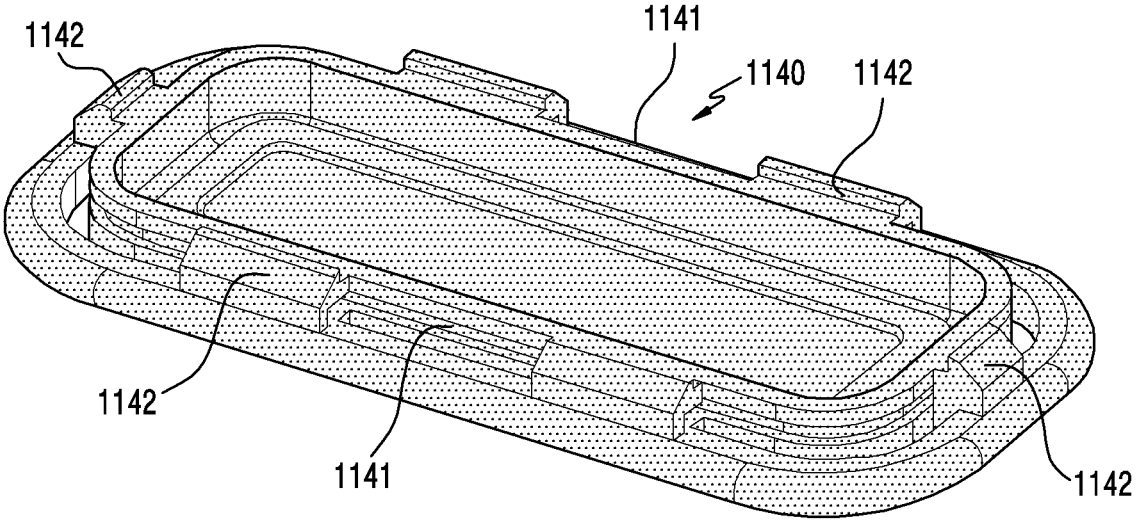

Referring to FIG. 11C, at least a portion of the sound component housing 1110 according to various embodiments, for example, an upper end circumference of an upper frame 1114 coupled with the sealing member 1140, may include a plurality of first slots 1111 and a plurality of first protrusions 1112. Each of the first protrusions 1112 may be disposed between the first slots 1111. Referring to FIG. 11D, an upper end circumference of the sealing member 1140 to which the sound component housing according to various embodiments is coupled may include a plurality of second slots 1141 and a plurality of second protrusions 1142, and each of the second protrusions 1142 may be disposed between the second slots 1141.

Referring to FIG. 11A, the second protrusions 1142 are coupled to the first slots 1111 and the first protrusions 1112 are coupled to the second slots 1141, such that the first slots 1111 and the first protrusions 1112 and the second slots 1141 and the second protrusions 1142 serve as a portion of the coupling structure between the sound component housing 1110 and the sealing member 1140.

Figure 12:
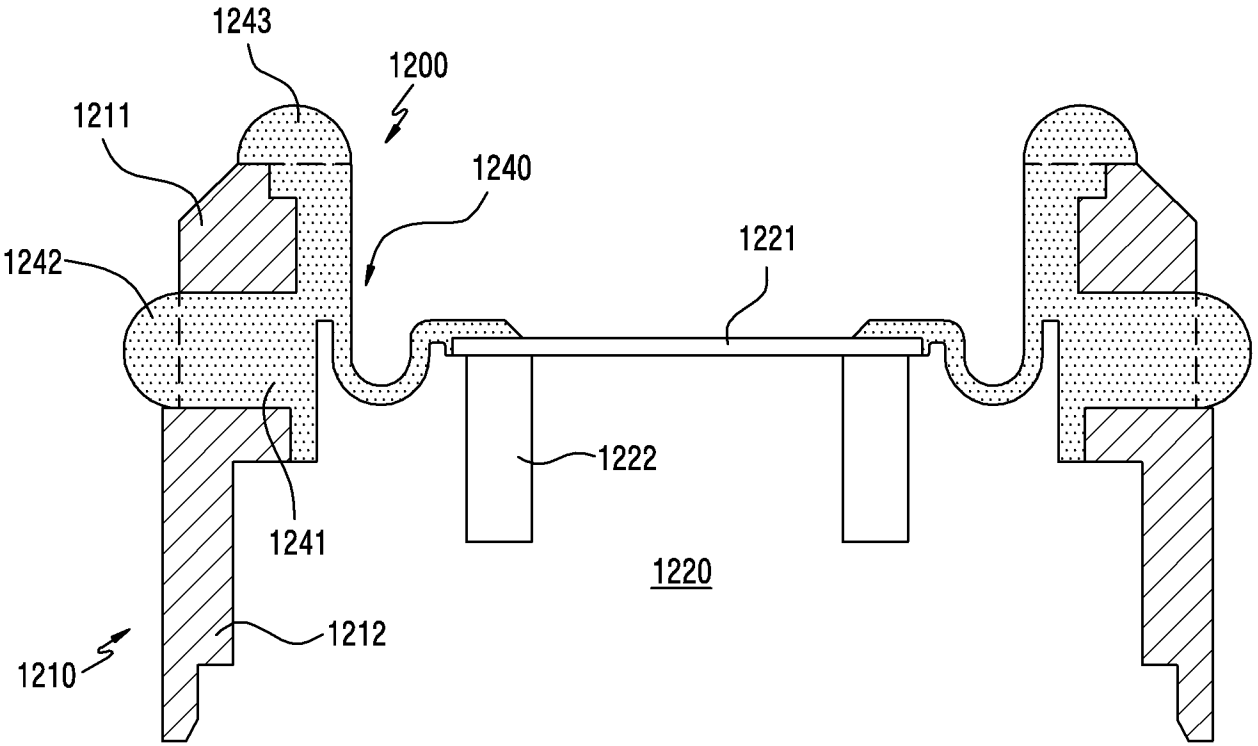
FIG. 12, FIG. 13, FIG. 14, FIG. 15, FIG. 16, FIG. 17, FIG. 18, FIG. 19, FIG. 20 and FIG. 21 are cross sectional views illustrating configurations of other sound components according to various embodiments.

Referring to FIG. 12, a sound component 1200 according to various embodiments is the same as the sound component 1000 illustrated in FIGS. 10A to 10D in other configurations except for a sealing portion and a sound component housing, and thus the other configurations will not be described in detail to avoid a redundant description thereof.

A sealing member 1240 according to various embodiments may be coupled with at least a portion of the sound component housing 1210. For example, the sealing member 1240 may include a sealing body 1241, a first sealing portion 1242, and a second sealing portion 1243. At least a portion of the sound component housing 1210 may include at least one frame disposed in a side direction.

The sound component 1200 according to various embodiments may include the first sealing portion 1242 protruding in the third direction, and the second sealing portion 1243 facing toward the first direction. The sealing member 1240 may be in contact with a front surface and a side surface or a rear surface and a side surface of an electronic device (not shown) in a pressed state, and may serve as a waterproof structure to prevent intrusion of foreign substances into the electronic device having the sound component mounted therein.

For example, the first sealing portion 1242 may have a semicircular cross section, and the second sealing portion 1243 may have a semicircular cross section. Each of the first and second sealing portions 1242, 1243 may be pressed (in close contact with a front surface cover, a side surface cover, or a rear surface cover of the electronic device in a pressed state), and may perform a waterproof function of preventing intrusion of foreign substances into a speaker 1220.

A portion of the sound component housing 1210 with which the sealing member 1240 according to various embodiments is injection-molded may include one frame or two frames. The two or more frames 1211, 1212 forming the sound component housing 1210 may be molded as a single body, and may be injection-molded with the sealing member 1240, or may be molded as two or more separate bodies and may be respectively injection-molded with the sealing member 1240.

The sound component housing 1210 formed of the two frames 1211, 1212 according to various embodiments may include the upper frame 1211 into which a vibration portion 1221 and the sealing member 1240 are inserted, and the lower frame 1212 into which a fusing terminal (not shown) of a coil 1222 of the speaker 1210 is inserted. When the sound component housing 1210 is formed of one frame, it may be difficult to insert the coil fusing terminal due to a double-shot injection molding structure. However, when the sound component housing 1210 is formed of two frames 1211, 1212, the fusing terminal of the coil 1222 may be inserted into the lower frame 1212 and thus it may be easy to manufacture the sound component 1200 by insert-injection molding.

Figure 13:
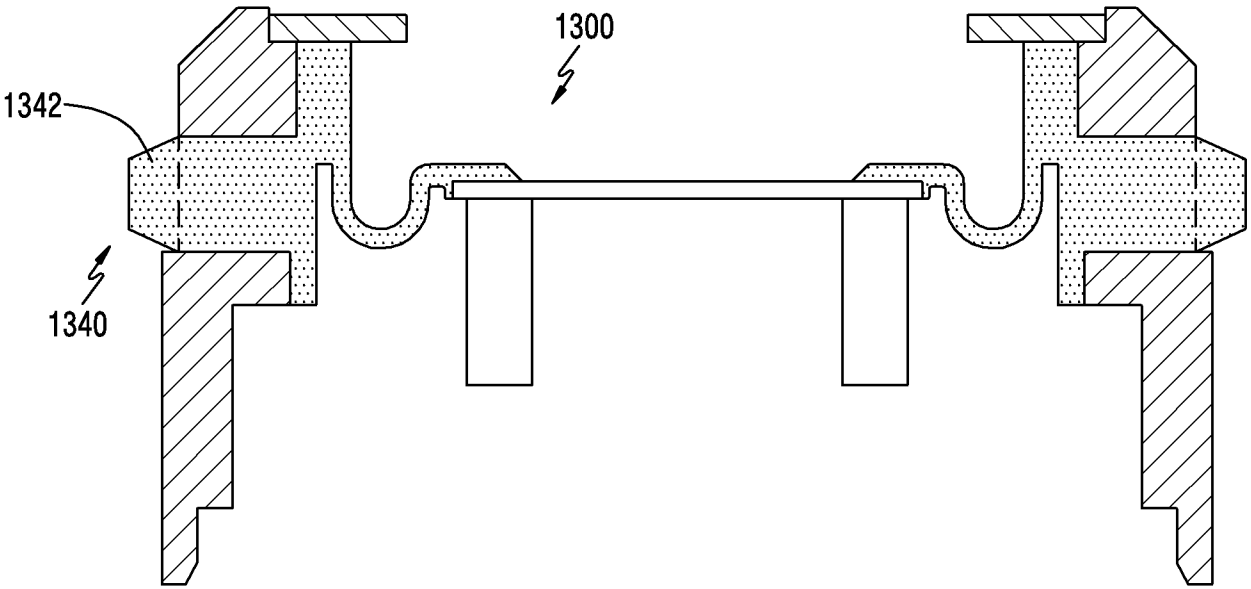

Referring to FIG. 13, a sound component 1300 according to various embodiments is the same as the sound component 1000 illustrated in FIGS. 10A to 10D in other configurations except for the shape of the sealing portion, and thus the other configurations will not be described in detail to avoid a redundant description thereof.

The sound component 1300 according to various embodiments may include a sealing member 1340, and the sealing member 1340 may include a sealing portion 1342 having a trapezoidal cross section. For example, the cross section of the sealing portion 1342 may be formed in an isosceles trapezoid shape. However, the cross section of the sealing portion 1342 is not limited to a semicircular shape or a trapezoidal shape, and may be formed in various shapes.

Figure 14:
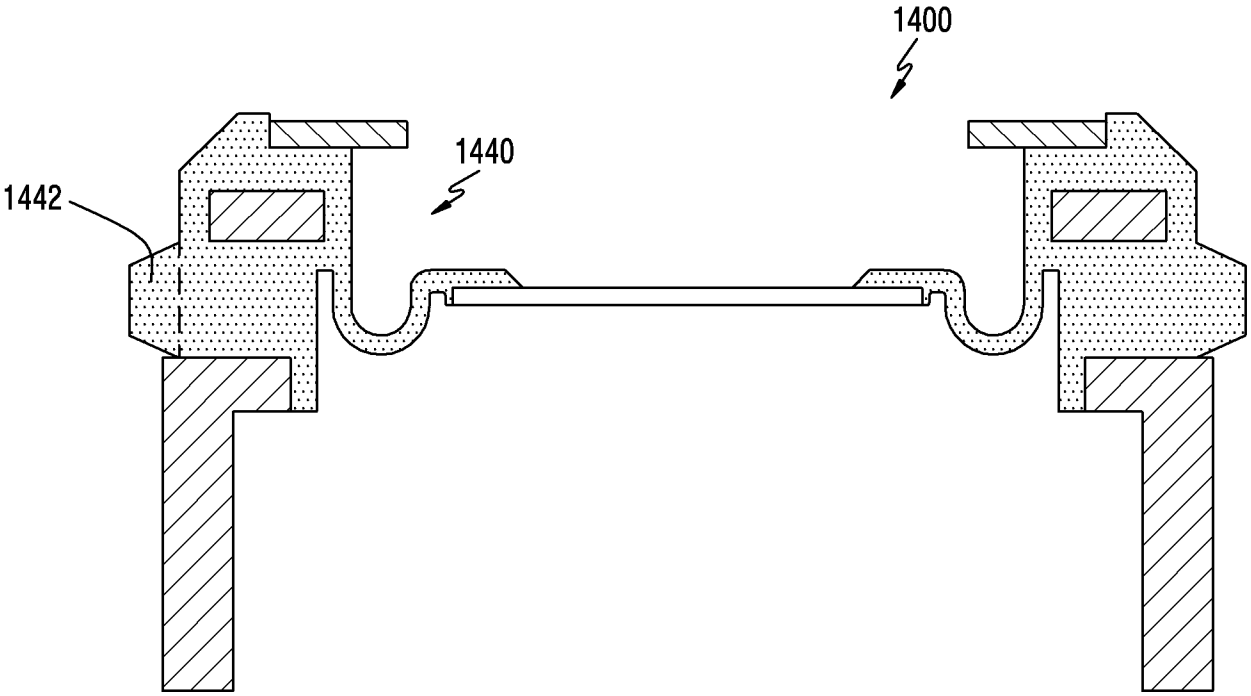

Referring to FIG. 14, a sound component 1400 according to various embodiments is the same as the sound component 1100 illustrated in FIGS. 11A to 11D in other configurations except for the cross section of the sealing portion, and thus the other configurations will not be described in detail to avoid a redundant description thereof.

The sound component 1400 according to various embodiments may include a sealing member 1440, and the sealing member 1440 may include a sealing portion 1442 having a trapezoidal cross section. For example, the cross section of the sealing portion 1442 may be formed in an isosceles trapezoid shape. However, the cross section of the sealing portion 1442 is not limited to a semicircular shape or a trapezoidal shape, and may be formed in various shapes.

Figure 15:
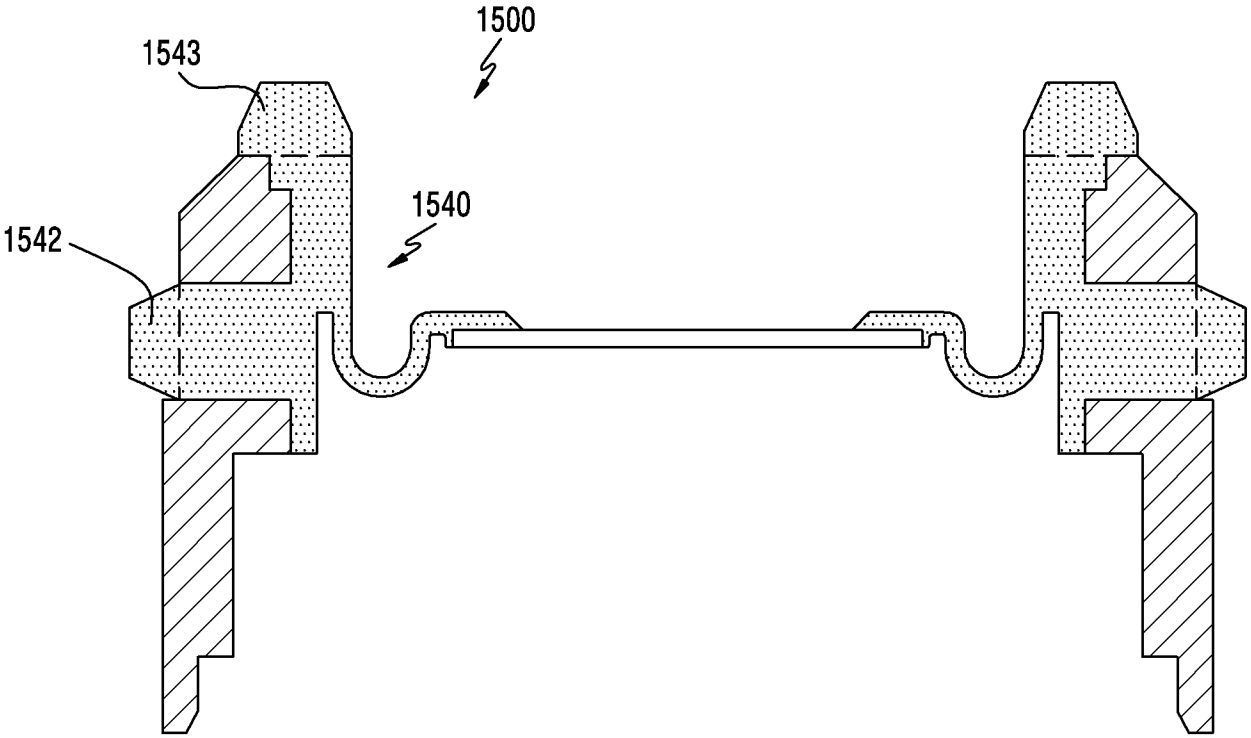

Referring to FIG. 15, a sound component 1500 according to various embodiments is the same as the sound component 1200 illustrated in FIG. 12 in other configurations except for the cross sections of the first and second sealing portions, and thus the other configurations will not be described in detail to avoid a redundant description thereof.

The sound component 1500 according to various embodiments may include a sealing member 1540, and the sealing member 1540 may include first and second sealing portions 1542, 1543 each having a trapezoidal cross section. For example, the cross section of each of the first and second sealing portions 1542, 1543 may be formed in an isosceles trapezoid shape. However, the cross section of each of the first and second sealing portions 1542, 1543 is not limited to a semicircular shape or a trapezoidal shape, and may be formed in various shapes.

Figure 16:
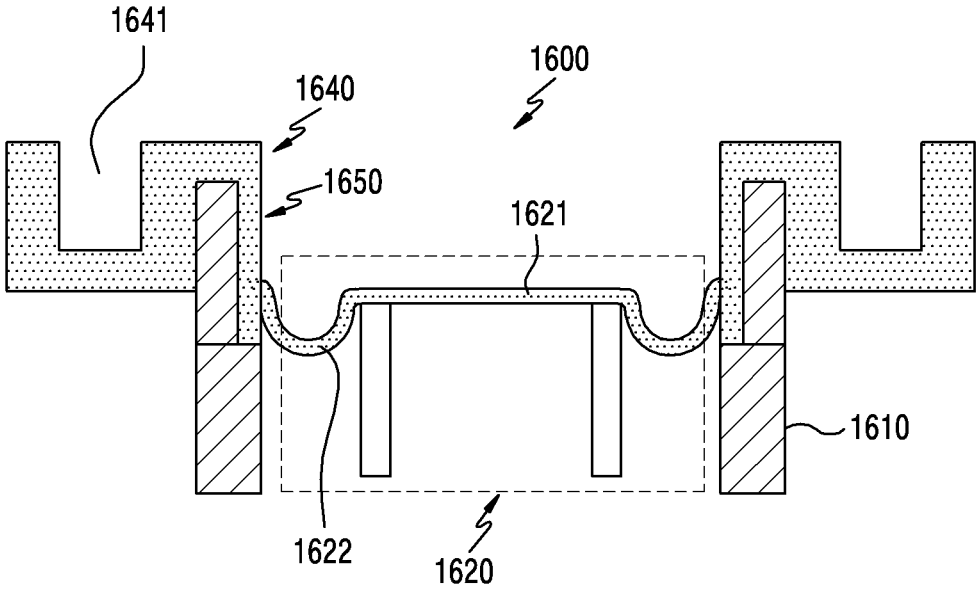

Referring to FIG. 16, a sound component 1600 according to various embodiments may include a sound component housing 1610, a vibration portion coupler 1650, a speaker 1620, and a waterproof structure 1640. For example, the configuration of the sound component housing 1610 is similar to the structure of the sound component housing 41 illustrated in FIG. 4B, and thus a detailed description thereof is omitted.

The sound component 1600 according to various embodiments may have at least a portion of the sound component housing 1610 and the waterproof structure 1640 formed by double-shot injection molding.

The waterproof structure 1640 according to various embodiments may be formed by a silicon rubber material, and may be a device that is coupled to an electronic device to prevent moisture penetration into the electronic device having the sound component 1600 mounted therein, and may be provided with at least one coupling recess 1641. The coupling recess 1641 may be coupled with a coupling protrusion formed on a front surface, a rear surface, or a side surface of the electronic device (not shown), and may perform a sealing function. The coupling recess 1641 may be recessed in the second direction, and one or more coupling recesses may be formed.

The speaker 1620 according to various embodiments may include first and second vibration portions 1621, 1622. For example, the first vibration portion 1621 may be a center dome portion and may include a vibration plate, and the second vibration portion 1622 may be a side dome portion and may include a curved portion.

The waterproof structure 1640 according to various embodiments may be integrally coupled with the speaker 1620 by the vibration portion coupler 1650, and may be integrally manufactured by injection molding.

Figure 17:
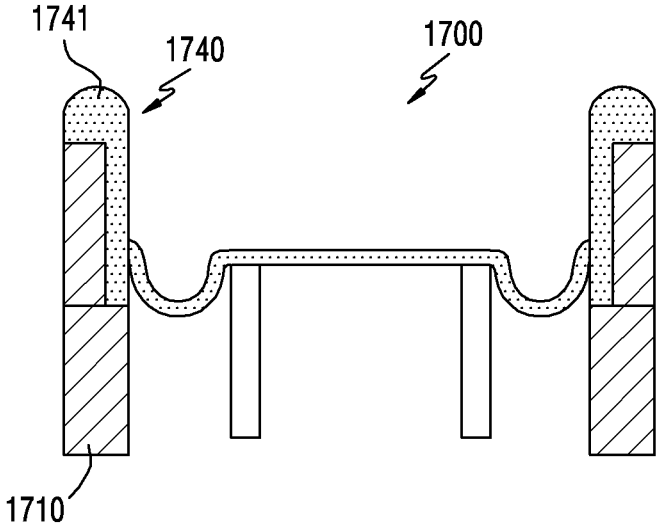

Referring to FIG. 17, a sound component 1700 according to various embodiments is the same as the sound component 1600 illustrated in FIG. 16 in other configurations except for a configuration related to a waterproof structure, and thus the other configurations will not be described in detail to avoid a redundant description thereof.

A waterproof structure 1740 according to various embodiments may be seated on an upper end of a sound component housing 1710, and may include a sealing portion 1741 protruding in the first direction. The sealing portion 1741 may have a semicircular cross section. However, the cross section of the sealing portion 1741 is not limited to the semicircular shape and may be changed to various shapes. The sealing portion 1741 may be integrally coupled with a sidewall of the sound component housing 1710 by double-shot injection molding.

Figure 18:
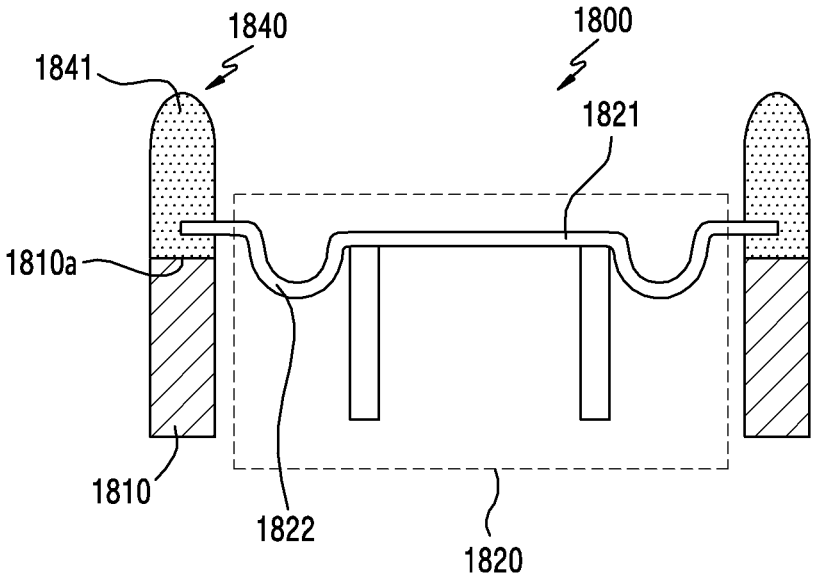

Referring to FIG. 18, a sound component 1800 according to various embodiments is the same as the sound component 1700 illustrated in FIG. 17 in other configurations except for a coupling structure between a waterproof structure and a speaker, and thus the other configurations will not be described in detail to avoid a redundant description thereof.

A waterproof structure 1840 according to various embodiments may be seated on an upper end 1810*a* of a sound component housing 1810, and may include a sealing portion 1841 protruding in the first direction. The sealing portion 1841 may have a semicircular cross section. However, the cross section of the sealing portion 1841 is not limited to the semicircular shape and may be changed to various shapes. For example, the waterproof structure 1840 may be formed by a silicon rubber material.

A second portion 1822 of a speaker according to various embodiments may be formed by a different material from that of the waterproof structure 1840. The second portion 1822 may be formed in a thin shape and a curved shape, and may be formed by double-shot injection molding and may be integrally coupled with the waterproof structure 1840. For example, the second portion 1822 may be bonded to or integrally formed with a first portion 1821 of the speaker 1822.

Figure 19:
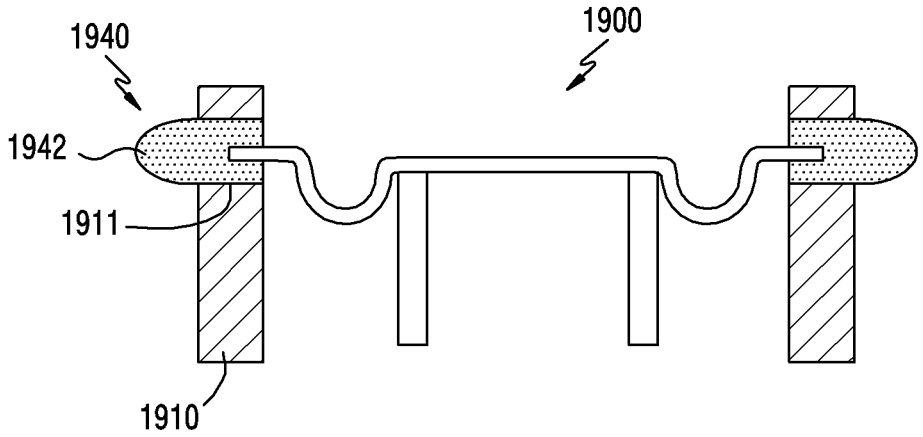

Referring to FIG. 19, a sound component 1900 according to various embodiments is the same as the sound component 1800 illustrated in FIG. 18 in other configurations except for a coupling structure of a sealing portion, and thus the other configurations will not be described in detail to avoid a redundant description thereof.

A waterproof structure 1940 according to various embodiments may be inserted into an opening 1911 formed on a sound component housing 1910, and may include a sealing portion 1942 protruding in the third direction. For example, the opening 1911 may be extended in the third direction, and the sealing member 1940 may be inserted in the third direction and fixed into the opening 1911. The sealing portion 1942 may have a semicircular cross section. However, the cross section of the sealing portion 1942 is not limited to the semicircular shape and may be changed to various shapes. For example, the sealing member 1940 may be formed by a silicon rubber material.

Figure 20:
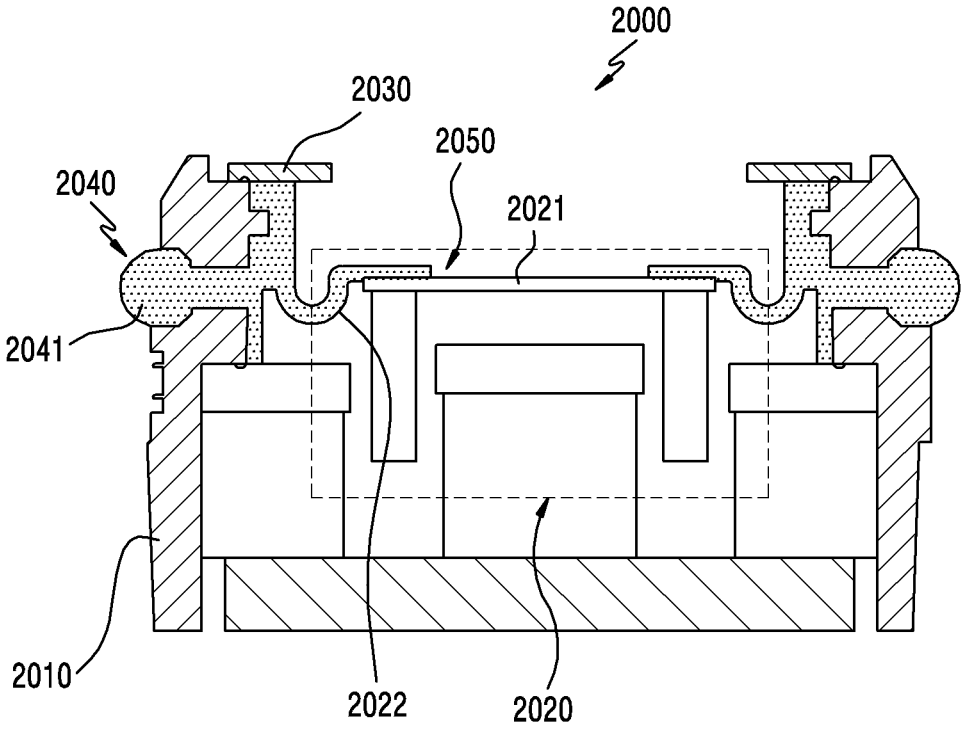

Referring to FIG. 20, a sound component 2000 according to various embodiments may have a sealing member 2040, a vibration portion 2050, and a protection member 2030 which are integrally formed with one another by injecting molding.

The sealing member 2040 and the vibration portion 2050 according to various embodiments may be integrally formed with each other by injection molding. For example, the sealing member 2040 and the vibration portion 2050 may be formed by the same material, for example, a liquid silicon rubber (LSR) material. The sealing member 2040, which is integrally formed with the vibration portion 2050 by molding, may be integrally coupled to the protection member 2030 of a different material, a metallic material, for example, a grill, by double-shot injection molding. The protection member 2030 may be formed by a SUS material.

According to various embodiments, the sealing member 2040, the vibration portion 2050, and the protection member 2030 may be integrally formed by two injecting molding processes, and may be assembled with the sound component housing 2000.

The sealing member 2040 according to various embodiments may include a sealing portion 2041 protruding in the third direction. For example, the sealing portion 2041 may have a semicircular or trapezoidal cross section. The sealing portion 2041 may be coupled to a front surface cover, a rear surface cover, or a side surface cover of the electronic device in close contact therewith, and may prevent moisture penetration into the electronic device having the sound component mounted therein.

The vibration portion 2050 according to various embodiments may be a portion of a speaker 2020 that vibrates. For example, the vibration portion 2050 may include first and second vibration portions 2021, 2022. For example, the first vibration portion 2021 may be a center dome portion, and may include a vibration plate, and the second vibration portion 2022 may be a side dome portion and may include a curved portion.

The sealing member 2040 integrally formed with the protection member 2030 and the vibration portion 2050 according to various embodiments may be coupled to a sound component housing 2010 by injection molding.

Figure 21:
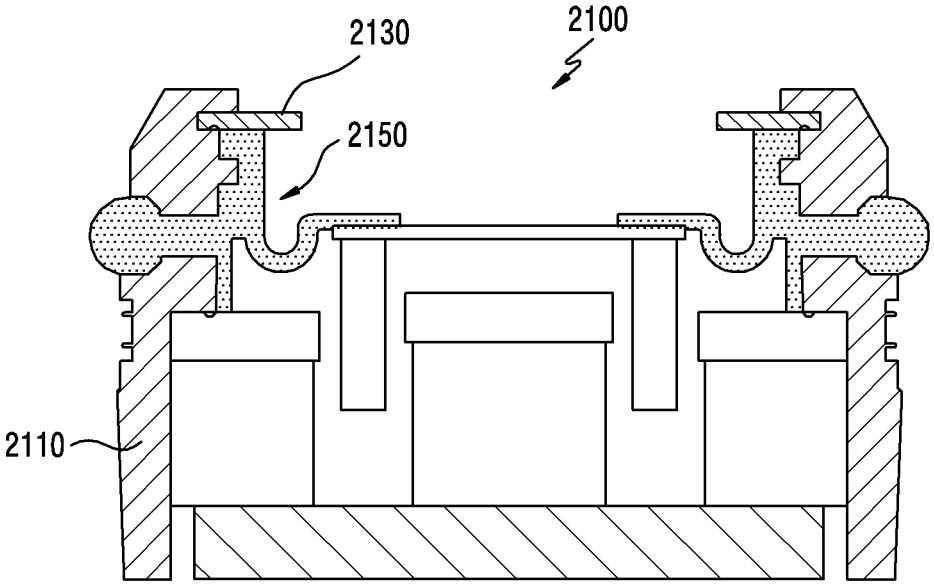

Referring to FIG. 21, a sound component 2100 according to various embodiments is the same as the sound component 2000 illustrated in FIG. 20 in other configurations except for a coupling structure between a sound component housing and a protection member, and thus the other configurations will not be described in detail to avoid a redundant description thereof.

A vibration portion 2150 formed with a protection member 2130 according to various embodiments by double-shot injection molding may be coupled to a sound component housing 2110 by injection molding. The protection member 2130 and the vibration portion 2150 integrally formed with each other may be integrally formed with the sound component housing 2100 by double-shot injection molding.

Figure 22:
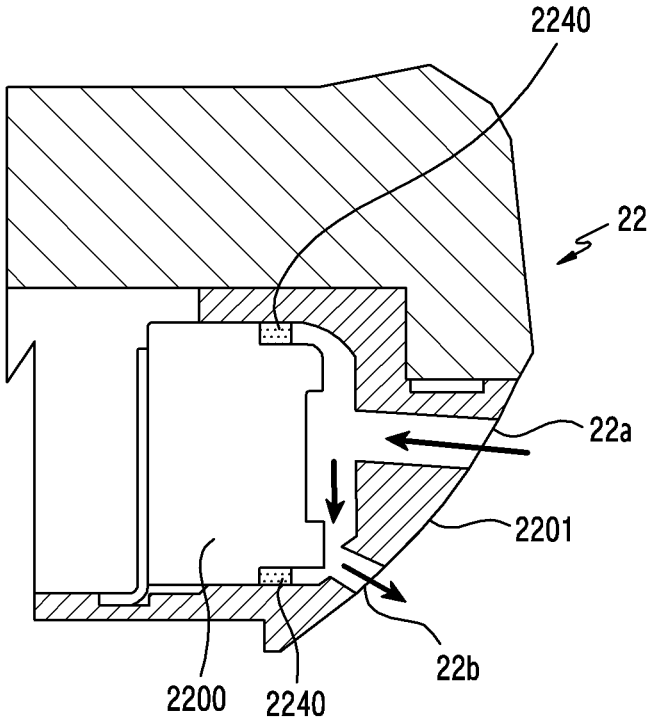
FIG. 22 is a cross sectional view illustrating a sound component disposed in an electronic device according to various embodiments.

Referring to FIG. 22, when a sound component 2200 according to various embodiments is sealed in an electronic device 22, a moisture inlet 22*a* and a moisture outlet 22*b* may be formed inside the electronic device 22 having the sound component 2200 mounted therein, and moisture penetration into the electronic device can be effectively minimized. The sound component 230 may be provided with a waterproof structure due to a sealing member 2240 (for example, a sealing portion), and moisture almost reaching the sound component 230 through the inlet 22*a* in a high pressure state may be discharged through the outlet 22*b*. The thick arrows may indicate moving directions of the moisture. A surface 2201 of the electronic device may be a front surface, a rear surface, or a side surface.

The present disclosure has been described with reference to various example embodiments thereof. It will be understood by a person skilled in the art that the present disclosure can be implemented in modified forms without departing from the essential characteristics of the present disclosure. Therefore, disclosed embodiments should be considered from a descriptive perspective, not from a limited perspective. The present disclosure is defined not by the detailed description but by the appended claims, and all differences should be understood as being included in the present disclosure.

What is claimed is:

1. A sound component mounted in an electronic device, the sound component comprising:

a sound component housing comprising: a first plate facing toward a first direction; a second plate facing toward a second direction opposite to the first direction; and a third plate facing toward a third direction perpendicular to the first and second directions;

a speaker disposed in the sound component housing to generate a sound in the first direction;

a protection member mounted to be exposed through the first plate in the first direction to protect the speaker; and a sealing member disposed between the sound component housing and the protection member, wherein the protection member and the sealing member are integrally formed with each other, and wherein the protection member comprises metallic material in a grill formation.

2. The sound component of claim 1, wherein the sealing member is disposed to surround an outer surface of the protection member, and comprises a first sealing portion protruding from a surface of the third plate of the sound component housing in the third direction.

3. The sound component of claim 2, wherein the first sealing portion is formed to have a substantially semicircular or trapezoidal cross section.

4. The sound component of claim 2, wherein the sealing member further comprises a second sealing portion protruding in the first direction.

5. The sound component of claim 2, wherein the protection member comprises:

a first portion which is in contact with at least a portion of the sealing member, is extended in the third direction, and faces the sound component housing;

a second portion which is bent from an end of the first portion at substantially a right angle, is extended in the first direction, and is in contact with at least another portion of the sealing member; and a third portion which is bent from an end of the second portion at substantially a right angle and is extended in the third direction.

6. The sound component of claim 5, wherein the sealing member comprises:

a sealing body which is in contact with the first and second portions of the protection member; and the first sealing portion which is integrally formed with the sealing body by injection molding, and protrudes from the sealing body in the third direction.

7. The sound component of claim 1, wherein the sealing member is disposed in contact with a front surface, a side surface, a rear surface, or any one of the front surface and the side surface of the electronic device to maintain a pressed state, and provides a waterproof structure of the electronic device.

8. The sound component of claim 1, wherein the protection member and the sealing member are formed by double shot injection molding.

9. A sound component comprising:

a sound component housing comprising: a first plate facing toward a first direction; a second plate facing toward a second direction opposite to the first direction; and a third plate facing toward a third direction perpendicular to the first and second directions;

a speaker disposed in the sound component housing, and provided with a vibration portion facing toward the first direction to generate a sound in the first direction;

a protection member mounted to be exposed through the first plate in the first direction to protect the speaker;

a sealing member coupled with the sound component housing; and a vibration portion coupler which couples the sealing member to the vibrating portion of the speaker, wherein the sealing member and the vibration portion are integrally formed with each other, and wherein the protection member comprises metallic material in a grill formation.

10. The sound component of claim 9, wherein the sealing member comprises:

a sealing body inserted into the sound component housing; and a first sealing portion integrally formed with the sealing body and protruding in the third direction.

11. The sound component of claim 10, wherein the sealing member and the vibration portion are formed by double injection molding.

12. The sound component of claim 9, wherein the vibration portion comprises:

a first portion disposed at a center of the speaker; and a second portion which is extended from the first portion, and is curved and coupled with the first portion.

13. The sound component of claim 12, wherein at least a portion of the vibration portion is coupled with the protection member.

14. The sound component of claim 9, wherein the vibration portion coupler comprises a coupling structure of a recess and a protrusion.

15. An electronic device comprising:

an electronic device housing provided with at least one opening; and at least one sound component mounted in the proximity of the at least one opening, wherein the at least one sound component comprises:

a sound component housing comprising: a first plate facing toward a first direction; a second plate facing toward a second direction opposite to the first direction; and a third plate facing toward a third direction perpendicular to the first and second directions;

a speaker disposed in the sound component housing to generate a sound in the first direction;

a protection member mounted to be exposed through the first plate in the first direction to protect the speaker; and a sealing member disposed between the sound component housing and the protection member, and disposed in contact with the electronic device housing in a pressed state, wherein the protection member and the sealing member are integrally formed with each other, and wherein the protection member comprises a grill.

16. The electronic device of claim 15, wherein the at least one opening is formed on any one of a front surface cover, a side surface cover, or a rear surface cover of the electronic device housing.

17. The electronic device of claim 15, wherein the protection member and the sealing member are formed by double injection molding.

* * * * *